US008380114B2

(12) United States Patent
Watanabe

(10) Patent No.: US 8,380,114 B2
(45) Date of Patent: Feb. 19, 2013

(54) IMAGE FORMING APPARATUS AND METHOD

(75) Inventor: Masahiro Watanabe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 408 days.

(21) Appl. No.: 12/659,486

(22) Filed: Mar. 10, 2010

(65) Prior Publication Data

US 2010/0232846 A1 Sep. 16, 2010

(30) Foreign Application Priority Data

Mar. 12, 2009 (JP) ..... 2009-059359
Apr. 17, 2009 (JP) ..... 2009-100559

(51) Int. Cl.
*G03G 15/20* (2006.01)
*G03G 21/20* (2006.01)
*G03G 15/14* (2006.01)
*G03G 15/00* (2006.01)

(52) U.S. Cl. ..... 399/341; 399/322; 399/320; 399/400; 399/388; 399/92

(58) Field of Classification Search ..... 399/322, 399/349, 92, 251, 305, 406, 341
See application file for complete search history.

(56) References Cited

U.S. PATENT DOCUMENTS

| | | | | |
|---|---|---|---|---|
| 5,218,411 | A * | 6/1993 | Kosugiyama et al. | 399/341 |
| 5,250,998 | A * | 10/1993 | Ueda et al. | 399/329 |
| 7,277,108 | B2 | 10/2007 | Tatematsu | |
| 2005/0244203 | A1 * | 11/2005 | Kamiyama | 399/341 |
| 2006/0133864 | A1 | 6/2006 | Tatematsu | |

FOREIGN PATENT DOCUMENTS

| | | | |
|---|---|---|---|
| JP | 07-053089 | | 2/1995 |
| JP | 10-167516 | | 6/1998 |
| JP | 10-279120 | | 10/1998 |
| JP | 3278319 | | 2/2002 |
| JP | 2002-080137 | | 3/2002 |
| JP | 2004069910 | A * | 3/2004 |
| JP | 2005-075500 | | 3/2005 |
| JP | 2005-309062 | | 11/2005 |
| JP | 2006-151543 | | 6/2006 |
| JP | 2006-168890 | | 6/2006 |

(Continued)

OTHER PUBLICATIONS

Machine translation of Akama, JP 2004069910 A Mar. 2004 Akama.*
Abstract of JP 2004-191858 published on Jul. 8, 2004.
Abstract of JP 2004-133377 published on Apr. 30, 2004.
Abstract of WO 2005/071496 published on Aug. 4, 2005.
Abstract of JP 08-262887 published on Oct. 11, 1996.

*Primary Examiner* — David Gray
*Assistant Examiner* — Sevan A Aydin
(74) *Attorney, Agent, or Firm* — Harness, Dickey & Pierce, P.L.C.

(57) ABSTRACT

An image forming apparatus including a fixing device having a first nip to fix toner to a recording medium; a conveyance device provided at a position downstream from the fixing device in a direction of conveyance of the recording medium to convey the recording medium further downstream; a guide member provided along a conveyance path of the recording medium between the fixing device and the conveyance device to contact and convey the recording medium from the fixing device to the conveyance device, the guide member having multiple through-holes formed therein and penetrating from a front surface of the guide member facing the conveyance path of the recording medium to a back surface of the guide member; and an airflow generator to generate an airflow through the multiple through-holes.

19 Claims, 11 Drawing Sheets

FOREIGN PATENT DOCUMENTS

| | | |
|---|---|---|
| JP | 2006-176265 | 7/2006 |
| JP | 2006-193234 | 7/2006 |
| JP | 2007-108550 | 4/2007 |
| JP | 4041728 | 11/2007 |
| JP | 4099098 | 3/2008 |
| JP | 4099193 | 3/2008 |

* cited by examiner

IMAGE FORMING APPARATUS AND METHOD

PRIORITY STATEMENT

The present patent application claims priority from Japanese Patent Application Nos. 2009-059359, filed on Mar. 12, 2009, and 2009-100559, filed on Apr. 17, 2009, both in the Japan Patent Office, each of which is hereby incorporated herein by reference in its entirety.

BACKGROUND

1. Technical Field

Illustrative embodiments described in this patent specification generally relate to an image forming apparatus such as a copier, a printer, or a facsimile machine that forms a toner image on a recording medium using an electrophotographic method, and more particularly, to a guide device to convey the recording medium having the toner image fixed thereon by a fixing device, and a method for controlling the image forming apparatus.

2. Description of the Related Art

Related-art image forming apparatuses, such as copiers, printers, facsimile machines, or multifunction devices having two or more of copying, printing, and facsimile functions, typically form a toner image on a recording medium (e.g., a sheet) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

The fixing device generally includes a rotatable fixing member such as a rotatable fixing roller or a rotatable fixing belt, each heated, and a rotatable pressing member such as a rotatable pressure roller or a rotatable pressing belt, pressed against the fixing member. A recording medium such as a sheet having an unfixed toner image thereon is passed between the fixing member and the pressing member, so that heat and pressure are applied to the toner image to melt and fix the toner image onto the sheet.

Increasingly, higher operating speeds, higher productivity, and greater compactness are required of image forming apparatuses. In order to meet such requirements, expansion of a nip that sandwiches a recording medium such as a sheet between the fixing member and the pressing member to apply heat and pressure to the sheet has been examined in a belt fixing method. For example, fixing devices often include additional rollers or members to wind the fixing belt or the pressing belt around the fixing roller or the pressure roller in order to extend the nip, or widen the nip, formed between the fixing roller and the pressure roller with the fixing belt or the pressing belt therebetween. The intention is simply to expand the area of contact between the fixing member and the pressing member, in order to achieve superior fixing performance, higher operating speed, and higher productivity.

However, because higher heat and greater pressure are applied to the sheet at the nip in the above-described fixing devices in order to achieve higher operating speed, sheets passing through the nip tend to curl as a result, and this curling may cause a sheet jam or folding of the sheet when the curled sheet enters a conveyance mechanism provided downstream from the fixing device. The above-described problem is particularly prominent in a case in which a gloss-imparting device, having a second nip between two rotary members of its own for imparting glossiness to the toner image formed on the sheet and also serving as the conveyance mechanism, is provided closer to the fixing device.

Further, a guide member for guiding the sheet is usually provided at an exit of the fixing device. When the curled sheet is discharged from the above-described fixing device, the sheet may collide with the guide member, wrinkling the sheet and (in duplex printing) leaving faint images on a back side of the sheet.

SUMMARY

In view of the foregoing, illustrative embodiments described herein provide an image forming apparatus that corrects curling of a recording medium between a fixing device and a conveyance device to prevent jamming and folding of the recording medium. Further, the image forming apparatus provides collision-free conveyance of the recording medium as the medium is discharged from the fixing device.

At least one embodiment provides an image forming apparatus including: a fixing device having a first nip to fix toner to a recording medium by heat and pressure; a conveyance device provided at a position downstream from the fixing device in a direction of conveyance of the recording medium where a leading edge of the recording medium reaches before a trailing edge of the recording medium is discharged from the first nip, to convey the recording medium further downstream; a guide member provided along a conveyance path of the recording medium between the fixing device and the conveyance device to contact and convey the recording medium from the fixing device to the conveyance device, the guide member having multiple through-holes formed therein penetrating from a front surface of the guide member facing the conveyance path of the recording medium to a back surface of the guide member; and an airflow generator to generate an airflow through the multiple through-holes from the front surface of the guide member to the back surface of the guide member.

At least one embodiment provides an image forming method including the steps of: fixing toner to a recording medium by heat and pressure using a fixing device having a first nip; conveying the recording medium further downstream using a conveyance device provided at a position downstream from the fixing device in a direction of conveyance of the recording medium where a leading edge of the recording medium reaches before a trailing edge of the recording medium is discharged from the first nip; contacting and conveying the recording medium from the fixing device to the conveyance device using a guide member provided along a conveyance path of the recording medium between the fixing device and the conveyance device, the guide member having multiple through-holes formed therein penetrating from a front surface of the guide member facing the conveyance path of the recording medium to a back surface of the guide member; and generating an airflow using an airflow generator through the multiple through-holes from the front surface of the guide member to the back surface of the guide member.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
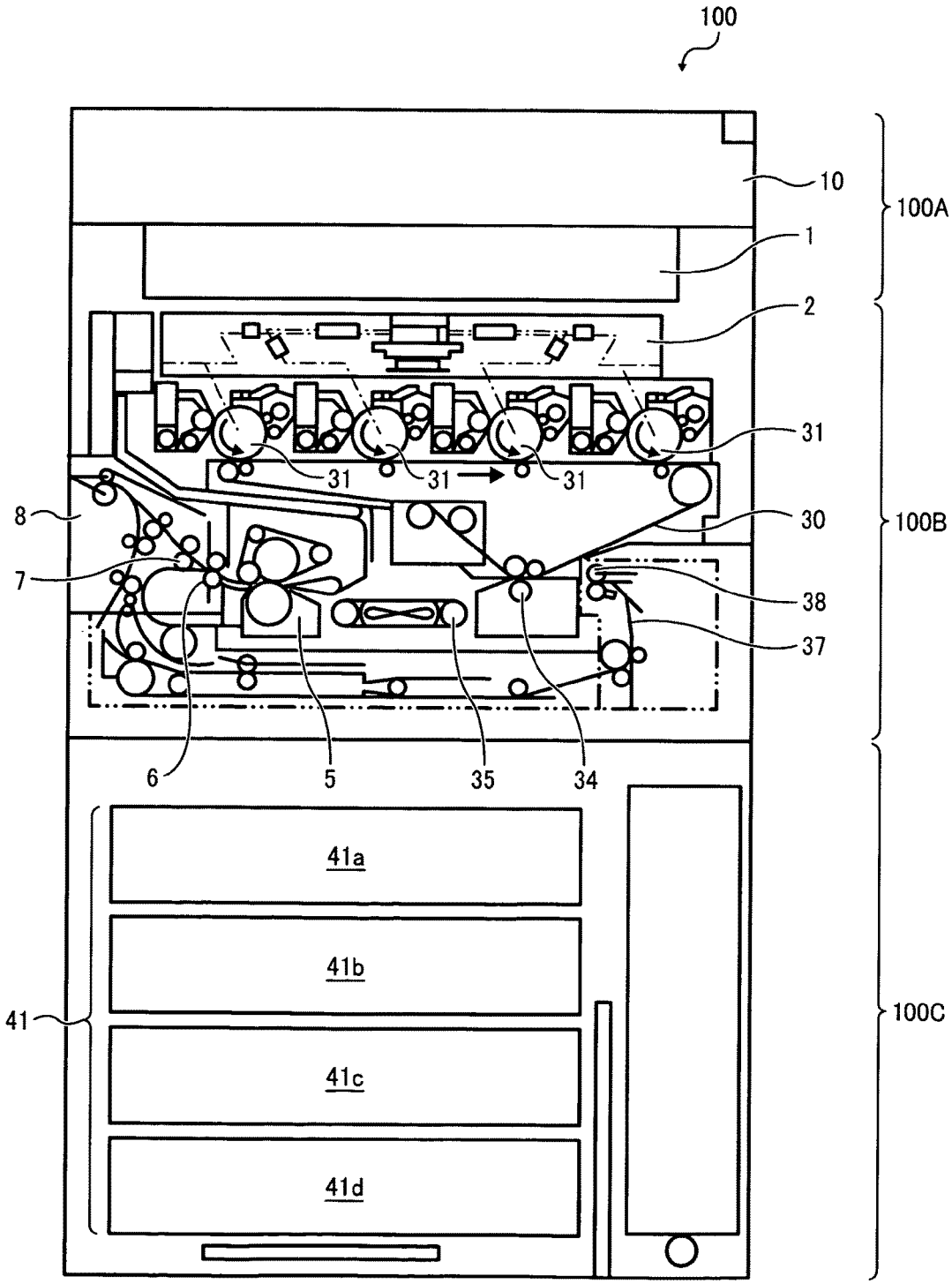
FIG. 1 is a vertical cross-sectional view illustrating an overall configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Reference is now made to the drawings, wherein like reference numerals designate identical or corresponding parts throughout the several views.

A description is now given of a configuration of an image forming apparatus according to illustrative embodiments.

FIG. 1 is a vertical cross-sectional view illustrating an example of an overall configuration of a digital full-color copier serving as an image forming apparatus 100 according to illustrative embodiments.

The image forming apparatus 100 includes an image reading unit 100A provided at the top of the image forming apparatus 100, an image forming unit 100B provided at the center of the image forming apparatus 100, and a sheet feeder 100C provided at the bottom of the image forming apparatus 100.

The image reading unit 100A includes a scanner 1 to optically read image data of documents, and an automatic document feeder (ADF) 10 to continuously convey the documents to the scanner 1.

The image forming unit 100B includes an intermediate transfer belt 30 having a transfer surface extending in a horizontal direction. A configuration for forming images of those colors in a relation of separated colors and complementary colors is provided above the intermediate transfer belt 30. Specifically, four photoconductors 31 each serving as an image carrier capable of carrying an image of a specific color, that is, yellow, magenta, cyan, or black, are arranged along the transfer surface of the intermediate transfer belt 30.

A writing unit 2 to direct a light beam based on the image data scanned by the scanner 1 or external image data onto a surface of each of the four photoconductors 31 is provided above the photoconductors 31. Each of the photoconductors 31 includes a drum rotatable in the same direction, that is, a counterclockwise direction in FIG. 1. A charger, a developing device, and a primary transfer device each performing image forming processes as the photoconductors 31 are rotated, and a cleaning device to collect residual toner adhering to the surfaces of the photoconductors 31 after primary transfer are provided around each of the photoconductors 31. It is to be noted that the developing device includes toner of a specific color, that is, yellow, magenta, cyan, or black.

The intermediate transfer belt 30 is stretched among a driving roller and driven rollers, and is rotatable in a direction same as the direction of rotation of the photoconductors 31 at positions contacting the photoconductors 31. The image forming unit 100B further includes a secondary transfer device 34 serving as a transfer roller at a position opposite one of the driven rollers. Further, a conveyance belt 35, a fixing device 5, a gloss-imparting device 6, and a pair of conveyance rollers 7 are provided, in that order, from the secondary transfer device 34 along a conveyance path of a sheet in a direction of conveyance of the sheet.

The sheet feeder 100C includes sheet feed trays 41*a*, 41*b*, 41*c*, and 41*d* (hereinafter collectively referred to as sheet feed trays 41) each storing a recording medium such as a sheet. A stack of sheets stored in the sheet feed trays 41 is sequentially separated one by one from the top of the stack of sheets and is conveyed through a conveyance path 37 to a registration unit 38 each included in a conveyance mechanism. The registration unit 38 corrects a skew of the sheet and determines a time to convey the sheet to a secondary transfer position based on the image forming processes.

In the image forming apparatus 100, the surface of the photoconductor 31 is evenly charged by the charger, and the writing unit 2 directs a light beam onto the charged surface of the photoconductor 31 based on the image data scanned by the scanner 1 or external image data to form an electrostatic latent image of the corresponding color on the surface of the photoconductor 31. The electrostatic latent image thus formed on the surface of the photoconductor 31 is developed by the developing device storing toner of the corresponding color so that a toner image of the corresponding color is formed on the surface of the photoconductor 31. The toner image thus formed is then primarily transferred onto the intermediate transfer belt 30 by the primary transfer device to which a predetermined amount of bias is applied. Toner images of yellow, magenta, cyan, and black are formed in the same manner as described above and are sequentially transferred onto the intermediate transfer belt 30 in a superimposed manner by an electrostatic force. Accordingly, a full-color toner image is formed on the intermediate transfer belt 30.

The full-color toner image thus formed on the intermediate transfer belt 30 is then transferred by the secondary transfer device 34 onto the sheet conveyed from the sheet feed trays 41. The sheet having the transferred full-color toner image thereon is conveyed to the fixing device 5, and the full-color toner image is fixed to the sheet at a fixing nip formed between a fixing member and a pressing member. Subsequently, glossiness is imparted to the fixed toner image on the sheet by the gloss-imparting device 6 as needed. Thereafter, the sheet having the full-color image thereon is conveyed by the pair of conveyance rollers 7 to a discharge unit 8, and is further conveyed from the discharge unit 8 along a discharge path to be discharged from the image forming apparatus 100. As a result, a sequence of the image forming processes is completed.

It is to be noted that the image forming apparatus 100 illustrated in FIG. 1 can provide higher fixing performance and improved glossiness imparting performance, and can handle, without decreasing productivity, a variety of types of sheets including thin paper and heavy paper and a variety of types of images with or without glossiness.

Figure 2:
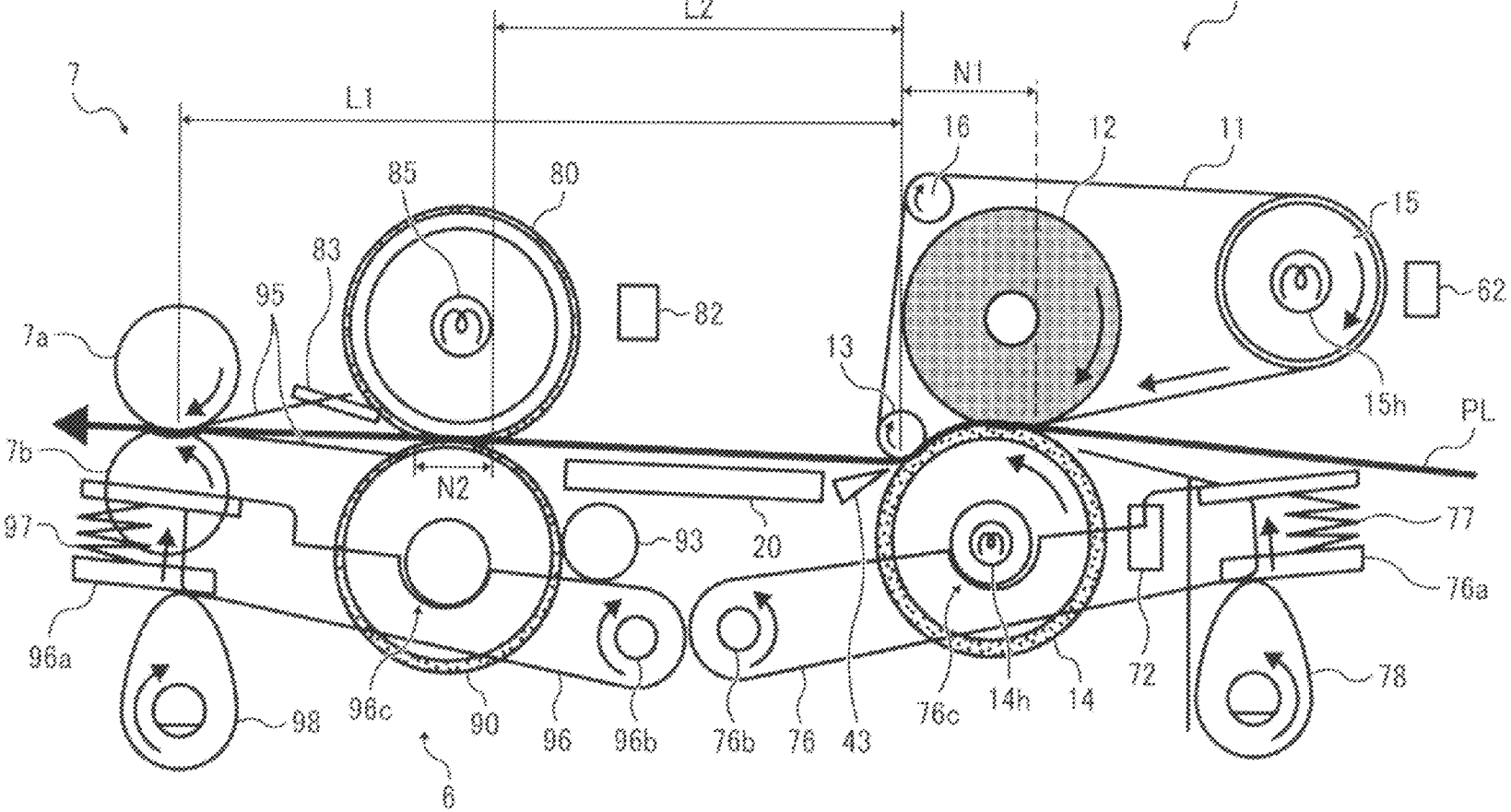
FIG. 2 is a vertical cross-sectional view illustrating a configuration used for fixing and subsequent processes included in the image forming apparatus illustrated in FIG. 1.

FIG. 2 is a vertical cross-sectional view illustrating a configuration used for fixing and subsequent processes included in the image forming apparatus 100 illustrated in FIG. 1.

The image forming apparatus 100 has two modes, that is, a mode for imparting glossiness to the toner image formed on the sheet (hereinafter referred to as a gloss mode) and a mode for not imparting glossiness to the toner image formed on the sheet (hereinafter referred to as a non-gloss mode). The image forming apparatus 100 includes the fixing device 5 including a rotatable fixing member such as a fixing belt 11 and a pressing member such as a pressure roller 14 pressed against the fixing member to form a fixing nip N1 for fixing the toner image onto the sheet; a guide device 20 provided along a conveyance path PL of the sheet between the fixing device 5 and the gloss-imparting device 6; the gloss-imparting device 6 including a first rotatable body such as a heating roller 80 having heating means therein such as a heating member 85, and a second rotatable body such as a pressing roller 90 pressed against the first rotatable body to form a nip N2 for imparting glossiness to the fixed toner image on the sheet; and the pair of conveyance rollers 7 to convey the sheet, positioned within a distance L1, that is, a distance within 210 mm from an exit of the fixing nip N1. The fixing device 5, the guide device 20, the gloss-imparting device 6, and the pair of conveyance rollers 7 are provided in that order along the conveyance path PL of the sheet relative to the direction of conveyance of the sheet.

The fixing device 5 includes a cylindrical fixing roller 12; a separation roller 13; a heat roller 15; a tension roller 16; the fixing belt 11 wound around the fixing roller 12, the separation roller 13, the heat roller 15, and the tension roller 16 with a predetermined amount of tension; and the pressure roller 14 rotatably pressed against the fixing belt 11 to form the fixing nip N1. Specifically, the pressure roller 14 is pressed against both the fixing roller 12 and the separation roller 13 with the fixing belt 11 therebetween so that the fixing nip N1 includes two nips respectively formed between the pressure roller 14 and the fixing roller 12 and between the pressure roller 14 and the separation roller 13. It is to be noted that a configuration including the fixing belt 11, the fixing roller 12, the separation roller 13, the heat roller 15, and the tension roller 16 is called as a fixing belt unit. A separation member 43, a leading edge of which is positioned closer to the pressure roller 14, is provided at the exit of the fixing nip N1 to separate the sheet discharged from the fixing nip N1 from the pressure roller 14.

The fixing belt 11 is a seamless belt for fixing unfixed toner T to a recording medium (hereinafter referred to as a sheet P). The fixing belt 11 has a multi-layered structure, in which an elastic layer such as a silicone rubber layer is laminated onto a substrate formed of a material such as nickel, stainless steel, or polyimide. For example, the substrate may be formed of a polyimide resin having high heat resistance, large strength, and low heat expansion. The substrate has an inner diameter of 115 mm, and silicone rubber having a thickness of 200 μm is laminated onto the substrate. Further, the silicone rubber may be coated with a fluorine tube such as a PFA (tetrafluoroethylene-perfluoroalkyl vinyl ether copolymer) having superior removability from toner, so that the PFA is provided as an outermost layer of the fixing belt 11.

The fixing roller 12 includes a hollow cylindrical substrate roller and a heat-resistant elastic layer formed of a material such as silicone foam rubber provided around the hollow cylindrical substrate roller. For example, a heat-resistant elastic layer formed of silicone foam rubber having a thickness of 14 mm may be provided around the hollow cylindrical substrate roller to provide the fixing roller 12 with an outer diameter of 65 mm.

An outer diameter of the separation roller 13 is smaller than that of the fixing roller 12. The separation roller 13 includes a metal core within which a heat pipe is provided, and the metal core is coated with a fluorine resin or solid rubber in order to prevent an uneven temperature distribution thereon in a direction of a shaft thereof. For example, an aluminum roller having a thickness of 1 mm is coated with a fluorine resin to provide the separation roller 13 having an outer diameter of 16 mm. The separation roller 13 is rotatable around the center of the shaft of the fixing roller 12, and is pressed against the pressure roller 14 with the fixing belt 11 therebetween.

The tension roller 16 includes a spring to apply a predetermined amount of tension to the fixing belt 11. In the fixing device 5, for example, the tension roller 16 applies tension of 9.8 N on one side, and 19.6 N on both sides in total.

The heat roller 15 is a hollow cylindrical roller formed of aluminum or iron and having, for example, an outer diameter of 35 mm and a thickness of 0.6 mm. The heat roller 15 includes a heater 15*h* such as a halogen heater serving as a heat source for heating the fixing belt 11. The heat roller 15 is provided within an inner circumference of the fixing belt 11 such that the heat roller 15 is not pressed against the pressure roller 14. In other words, the heat roller 15 is provided at a position such that the heat source is not provided at the fixing nip N1. It is to be noted that an induction heating (IH) mechanism may be alternatively used as the heat source. The fixing device 5 further includes a temperature detector 62 for detecting temperature at the point of contact between the fixing belt 11 and the heat roller 15.

The pressure roller 14 is a cylindrical roller in which an elastic layer formed of a material such as silicone rubber is provided around a metal core formed of aluminum or iron. For example, a hollow metal core formed of steel and having a thickness of 1 mm may be coated with silicone rubber having a thickness of 1.5 mm, and a PFA tube is provided around the silicone rubber as the outermost layer of the pressure roller 14, so that the pressure roller 14 having an outer diameter of 65 mm is provided. The pressure roller 14 has a heater 14*h* inside thereof, and the heater 14*h* is controlled to be turned on and off based on a temperature of the pressure roller 14 detected by a temperature detector 72. Accordingly, heat is not moved from the sheet P passing through the fixing nip N1 to the pressure roller 14.

A web cleaning unit, not shown, to remove residual toner, paper dust, and so forth adhering to the pressure roller 14 is provided around the pressure roller 14.

As illustrated in FIG. 2, the pressure roller 14 is provided with pressing means including a pressure lever 76, a spring 77, a pressing member 76*a*, and a cam 78. Although the pressure roller 14 is pressed against the fixing roller 12 and the separation roller 13 with the fixing belt 11 therebetween by the pressing means, a position of the pressure roller 14 is variable depending on types of sheets and a selected mode for imparting or not imparting glossiness to the toner image.

The pressure roller 14 is pressed against the fixing roller 12 and the separation roller 13 by the pressing means as follows. First, when the cam 78 is rotated at a certain angle in a counterclockwise direction in FIG. 2 by a driving force external to the pressing means and not shown, the cam 78 pushes the pressing member 76*a* upward. When the pressing member 76*a* is pushed upward, the spring 77 affixed to an end of the pressing member 76*a* pushes an end of the pressure lever 76 on the spring 77 side upward with a certain amount of pressure. Subsequently, the pressure lever 76 is rotated around a support shaft 76*b* in a counterclockwise direction in FIG. 2. Thereafter, a pressing part 76*c* provided at an intermediate position between the end of the pressure lever 76 on the spring 77 side and the support shaft 76*b* contacts a shaft of the pressure roller 14 to press the pressure roller 14 against the fixing roller 12. Accordingly, the pressure roller 14 contacts and is pressed against the fixing roller 12 and the separation roller 13 with the fixing belt 11 therebetween with a certain amount of pressure to form the fixing nip N1 including a nip 1 formed between the fixing roller 12 and the pressure roller 14 and a nip 2 formed between the separation roller 13 and the pressure roller 14 for fixing the toner T on the sheet P. It is to be noted that, alternatively, the spring 77 may be omitted from the pressing means. In such a case, the cam 78 is designed to directly push the end of the pressure lever 76 upward.

The pressure roller 14 digs into the fixing roller 12 to a certain depth, for example, from 3 mm to 3.5 mm, with the fixing belt 11 therebetween. Further, the pressure roller 14 is pressed against the separation roller 13 with a certain amount of pressure, for example, a force of 9.8 N on one side. Accordingly, the fixing nip N1 has a predetermined width of, for example, 35 mm. Such a wider fixing nip achieves superior fixing performance for various types of sheets, as well as higher operating speed and higher productivity.

When the fixing device 5 is driven, the pressure roller 14 is rotated in a counterclockwise direction in FIG. 2 by a driving motor, not shown, provided for the fixing device 5. Rotation of the pressure roller 14 is transmitted to the fixing roller 12 and the separation roller 13 via gears so that the fixing roller 12 and the separation roller 13 are rotatively driven in a clockwise direction in FIG. 2. Accordingly, the fixing belt 11 is rotated in a direction of discharge of the sheet P, that is, a clockwise direction in FIG. 2, while predetermined amount of tension is applied to the fixing belt 11 from the tension roller 16. During a fixing process, the fixing belt 11 is heated by the heater 15*h* provided inside the heat roller 15 serving as a driven roller until a temperature detected by the temperature detector 62 reaches a predetermined temperature, for example, a temperature appropriate for fixing the toner T to the sheet P.

Subsequently, the sheet P having the unfixed toner T thereon is conveyed to the fixing nip N1 from right to left in FIG. 2, and the toner T is melted and fixed to the sheet P by pressure and heat applied thereto at the fixing nip N1.

Most of the toner T is fixed to the sheet P at an entrance of the fixing nip N1. Because the toner T is sufficiently melted and is highly viscous at this time, the sheet P tends to adhere to the fixing belt 11 while passing through an intermediate portion of the fixing nip N1. At this time, a pressure of 5 $N/cm^2$ or more is required to keep the sheet P at that position on the fixing belt 11 while the sheet P is conveyed. In addition, a pressure at the intermediate portion of the fixing nip N1 is kept to 15 $N/cm^2$ or less so that glossiness is not imparted to the toner T on the sheet P. When the sheet P is discharged from the fixing nip N1, the separation roller 13 having a smaller diameter and a strong curvature separates the sheet P from the fixing belt 11. Further, the sheet P is separated from the pressure roller 14 by the separation member 43 to be discharged from the fixing nip N1.

A total period of time in which the sheet P is pressed between the fixing roller 12 and the pressure roller 14 and between the separation roller 13 and the pressure roller 14 at the fixing nip N1 in the fixing device 5 is 60 m/sec or longer relative to a linear velocity, and a half or more of all the width of the fixing nip N1 has a pressure in a range between 15 $N/cm^2$ and 30 $N/cm^2$ during the gloss mode. Accordingly, the toner T on the sheet P including heavy paper having a weight of about 300 $g/m^2$ can be sufficiently fixed to the sheet P by the fixing device 5.

The width of the fixing nip N1 at the intermediate portion thereof can be adjusted by changing a contact state on the fixing belt 11 between the fixing roller 12 and the pressure roller 14. When the sheet P having a weight equal to or less than that of regular paper is used, the contact state between the fixing roller 12 and the pressure roller 14 is adjusted to increase the width of each of the nip 1, the intermediate portion, and the nip 2 of the fixing nip N1 such that pressure at the fixing nip N1 is reduced. In a case in which heat supply is increased when thin paper such as regular paper is used, an amount of pressure at the fixing nip N1 is reduced to prevent an increase in glossiness of the toner T on the sheet P. Accordingly, in the non-gloss mode to be described in detail later, a degree of glossiness same as that of a toner image formed on heavy paper may be reliably kept in a toner image formed on a sheet having a weight equal to or less than that of regular paper by adjusting the width of the fixing nip N1 even though such a sheet tends to have an excessive amount of heat. By contrast, in the gloss mode also to be described in detail later, the width of each of the nip 1, the intermediate portion, and the nip 2 of the fixing nip N1 is adjusted based on a thickness of the sheet P to adjust an amount of pressure at the fixing nip N1 so that a certain degree of glossiness is reliably imparted to the toner T on the sheet P regardless of types of sheets. As a result, reliability of imparting a desired degree of glossiness to the toner T on the sheet P can be improved in both the gloss mode and the non-gloss mode.

For example, an amount of pressure at the entrance of the fixing nip N1 in the direction of conveyance of the sheet P, that is, the nip 1 formed between the pressure roller 14 and the fixing roller 12, and that at the exit of the fixing nip N1 in the direction of conveyance of the sheet P, that is, the nip 2 formed between the pressure roller 14 and the separation roller 13, are set in a range between 15 N/cm$^2$ and 30 N/cm$^2$, respectively. The intermediate portion between the entrance and the exit of the fixing nip N1 is set in a range between 5 N/cm$^2$ and 15 N/cm$^2$. In a case in which glossy paper is used during the gloss mode, a width of each of the nip 1, the intermediate portion, and the nip 2 of the fixing nip N1 is set to 20 mm, 13 mm, and 2 mm, respectively, by the pressing means. By contrast, in a case in which regular paper is used during the non-gloss mode, a width of each of the nip 1, the intermediate portion, and the nip 2 of the fixing nip N1 is set to 15 mm, 13 mm, and 1 mm, respectively, by the pressing means.

The sheet P discharged from the fixing device 5 is then conveyed to the gloss-imparting device 6 through the guide device 20 provided between the fixing device 5 and the gloss-imparting device 6. The guide device 20 includes at least a guide member 21 and an airflow generator unit 23. Because higher heat and pressure are applied to the sheet P at the fixing nip N1 and the separation roller 13 having a smaller curvature is used to separate the sheet P from the pressure roller 14, the sheet P discharged from the fixing device 5 tends to be curled up. To solve such a problem, the guide device 20 according to illustrative embodiments is provided to correct curling or the like of the sheet P and to appropriately guide a leading edge of the sheet P to the direction of conveyance of the sheet P. Accordingly, wrinkling of the sheet P and sheet jam in the gloss-imparting device 6 can be prevented, thereby reliably conveying the sheet P. A configuration of the guide device 20 is described in detail later.

The gloss-imparting device 6 includes the heating roller 80 serving as the first rotatable body having the heating member 85 therein, and the pressing roller 90 serving as the second rotatable body pressed against the first rotatable body to form the nip N2 for imparting glossiness to the fixed toner image on the sheet P using heat and pressure.

The gloss-imparting device 6 further includes a temperature detector 82 for detecting a temperature on a surface of the heating roller 80 at a portion closer to an entrance of the nip N2. The heating member 85 such as a halogen heater is turned on and off based on the temperature detected by the temperature detector 82 to keep the temperature on the surface of the heating roller 80 constant.

The temperature on the surface of the heating roller 80 is controlled to appropriately impart glossiness to the fixed toner image on the sheet P when the gloss mode is selected. For example, the temperature on the surface of the heating roller 80 to contact the fixed toner image on the sheet P is lower than the temperature on the surface of the fixing belt 11 of the fixing device 5. Alternatively, it is preferable that the temperature on the surface of the heating roller 80 be in a range between a temperature of the sheet entering into the gloss-imparting device 6 and a temperature of the sheet immediately after discharging from the fixing device 5.

Further alternatively, it is preferable that the temperature on the surface of the heating roller 80 be in a range between a softening temperature of the toner and a ½ flow starting temperature of the toner, each measured using a flow tester, for example, CFT-500D manufactured by Shimadzu Corporation, under a condition of a load of 5 kg/cm$^2$ and an increasing temperature of 3.0 C.°/min using a nozzle with a diameter of 1.00 mm and a length of 10.0 mm. It is to be noted that the ½ flow starting temperature is a medium temperature between a flow starting temperature and a flow ending temperature of the toner.

Specifically, the temperature on the surface of the heating roller 80 is preferably in a range between 60 C.°, that is, a softening temperature of the toner, and 137 C.°, that is, a ½ flow starting temperature of the toner, more preferably in a range between 60 C.° and 120 C.°, that is, a flow starting temperature of the toner, and most preferably in a range between 80 C.° and 100 C.°. It is to be noted that a temperature of the toner varies depending on a color of the toner, a toner lot, and so forth, and the temperature of the toner herein indicates an average temperature of the toner.

While the sheet P is passing through the fixing device 5, heat and pressure are applied to the unfixed toner T on the sheet P at the fixing nip N1 so that all the toner layer of the unfixed toner T on the sheet P from a top surface of the toner T to the surface of the sheet P is melted to be fixed to the sheet P. The toner T tends to adhere to the sheet P when a certain degree of leveling is performed and the surface of the toner T has a large viscosity.

By contrast, only an amount of heat necessary for leveling the surface of the toner image is applied while the sheet P is passing through the gloss-imparting device 6 because the toner image is already fixed to the sheet P by the fixing device 5. It is to be noted that leveling means a process to smooth the surface of the toner image to impart glossiness to the toner image. Although heat and pressure are applied at the nip N2 to the toner image on the sheet P passing through the gloss-imparting device 6, all the toner layer of the toner image is not melted but only the surface layer of the toner image is softened because the temperature on the surface of the heating roller 80 is set in a range between the temperature of the sheet P entering into the gloss-imparting device 6 and the temperature of the sheet P immediately after discharging from the fixing device 5, that is, in a range between 60 C.° and 120 C.° as described above. As a result, only the surface layer of the toner image is leveled by a flat surface of the heating roller 80 while a color of the toner image is kept as it is, thereby increasing glossiness of the toner image. At this time, because the viscosity of the surface of the toner image is not as strong as that during the fixing process, the sheet P is reliably separated from the heating roller 80 having a diameter in a range between 30 mm and 40 mm. In other words, a separation member 83 provided at an exit of the nip N2 may be omitted, thereby achieving simplification of the configuration of the gloss-imparting device 6 and cost reduction. Further, because the offset caused by a process of melting the all the toner layer of the toner T performed during the fixing process can be prevented, a cleaning member 93 that removes residual toner from the surface of the pressing roller 90 may be omitted, thereby achieving further simplification of the configuration of the gloss-imparting device 6 and cost reduction.

The pressing roller 90 is a cylindrical roller having a metal core formed of aluminum, iron, or the like, and an elastic layer formed of silicone rubber or the like provided on the metal core. The pressing roller 90 is provided with pressure adjustment means including a pressure lever 96, a spring 97, a pressing member 96*a*, and a cam 98. During the gloss mode, the pressing roller 90 is pressed against the heating roller 80 by the pressure adjustment means.

When the cam 98 is rotated at a certain angle in a clockwise direction in FIG. 2 by an external driving force, the pressing member 96*a* is pushed upward by the cam 98. When the pressing member 96*a* is pushed upward, the spring 97 affixed to an end of the pressing member 96*a* pushes an end of the pressure lever 96 on the spring 97 side upward with a certain amount of pressure, and the pressure lever 96 is rotated around a support shaft 96*b* in a clockwise direction in FIG. 2. Subsequently, a pressure portion 96*c* positioned between the end of the pressure lever 96 on the spring 97 side and the support shaft 96*b* contacts a shaft of the pressing roller 90 to press the pressing roller 90 against the heating roller 80. As a result, the pressing roller 90 contacts and presses the heating roller 80 with a certain amount of pressure to form the nip N2 for imparting glossiness to the toner image on the sheet P. It is to be noted that the spring 97 may be omitted from the pressure adjustment means, and in such a case, the cam 98 is designed to directly push the end of the pressure lever 96 upward.

A pressure applied to the pressing roller 90 by the pressure adjustment means is controlled by adjusting the rotation angle of the cam 98. The heating roller 80 and the pressing roller 90 are separated from each other at a certain rotation angle of the cam 98 to open the nip N2.

During the gloss mode, it is preferable that a pressure at the nip N2 be adjusted by the pressure adjustment means in a range between 15 N/cm$^2$ and 30 N/cm$^2$. Accordingly, when the sheet P conveyed from the fixing device 5 passes through the gloss-imparting device 6, a predetermined amount of pressure as well as heat are applied to the fixed toner image on the sheet P at the nip N2 so that the surface layer of the fixed toner image is leveled and provided with glossiness.

When the sheet P having a length shorter than 210 mm is used during the non-gloss mode, an amount of pressure at the nip N2 is set to be smaller than that set during the gloss mode by the pressure adjustment means. For example, in such a case, the amount of pressure at the nip N2 is set preferably to less than 15 N/cm$^2$, and more preferably to 5 N/cm$^2$ or less. Here, the pressure at the nip N2 means an average amount of pressure in all the width of the nip N2. As a result, when the sheet P passes between the heating roller 80 and the pressing roller 90, glossiness of the toner image on the sheet P is not increased because of such a smaller amount of pressure at the nip N2, and the heating roller 80 and the pressing roller 90 only convey the sheet.

When the sheet P having a length equal to or longer than 210 mm is used during the non-gloss mode, it is preferable that the nip N2 formed between the heating roller 80 and the pressing roller 90 be opened by the pressure adjustment means.

During the non-gloss mode, a thin long sheet having a weight of 80 g/m$^2$ or less and a size of, for example, A3 size, may be used as the sheet P. In such a case, minute wrinkles or the like may appear on the sheet P due to bending and tension caused by a slight difference in a linear velocity of the sheet P between the fixing device 5 and the gloss-imparting device 6. To solve such a problem, the heating roller 80 and the pressing roller 90 in the gloss-imparting device 6 are separated from each other. At this time, although the sheet P only passes through the gloss-imparting device 6, a leading edge of the sheet P discharged from the fixing nip N1 of the fixing device 5 reaches the pair of conveyance rollers 7 because the length of the sheet P is equal to or longer than 210 mm, so that the sheet P is sandwiched and conveyed by the pair of conveyance rollers 7. As a result, the toner image formed on the sheet P is rarely touched by the heating roller 80 and the pressing roller 90 to provide higher image qualities while the sheet P is reliably conveyed.

When the heating roller 80 and the pressing roller 90 are separated from each other, it is preferable that a gap between the heating roller 80 and the pressing roller 90 be equal to or less than 2 mm. If the gap between the heating roller 80 and the pressing roller 90 is greater than 2 mm, the sheet P tends to be offset from the conveyance path PL of the sheet P, causing sheet jam.

It is preferable that the surface of each of the heating roller 80 and the pressing roller 90 be coated with a fluorine resin. As a result, when the heating roller 80 and the pressing roller 90 are separated from each other to provide the gap of 2 mm or less therebetween to cause the sheet P to pass as described above during the non-gloss mode, although the surface of the toner image may partially contact the heating roller 80, scraping of the toner image can be prevented because a fluorine resin layer provided on the surface of the heating roller 80 has superior releasing performance.

The gloss-imparting device 6 having the above-described configuration can reliably provide a target level of glossiness to the toner image in the gloss mode, and can improve reliability to provide the target level of glossiness to the toner image for both the gloss mode and the non-gloss mode.

The gloss-imparting device 6 is provided at a position where the leading edge of the sheet P reaches the nip N2 of the gloss-imparting device 6 before the trailing edge of the sheet P is discharged from the fixing nip N1. For example, the heating roller 80 and the pressing roller 90 in the gloss-imparting device 6 are positioned such that a distance L2 from the exit of the fixing nip N1 in the fixing device 5 to the entrance of the nip N2 in the gloss-imparting device 6 is set preferably in a range between 60 mm and 182 mm, more preferably in a range between 70 mm and 150 mm, and most preferably in a range between 80 and 100 mm. It is preferable that the maximum length of the distance L2 be a length of the sheet P having the minimum size. For example, in a case in which the sheet P having a B5 size is conveyed in portrait orientation with a latitudinal direction thereof as the direction of conveyance of the sheet P, the distance L2 is set to 182 mm. In a case in which the sheet P having a half letter size is conveyed in portrait orientation with a latitudinal direction thereof as the direction of conveyance of the sheet P, the maximum length of the distance L2 is set to 150 mm.

The sheet P discharged from or passing through the gloss-imparting device 6 is then conveyed to the pair of conveyance rollers 7. For example, it is preferable that two guide plates 95 be provided above and below the conveyance path PL of the sheet P, respectively, between the gloss-imparting device 6 and the pair of conveyance rollers 7, and the guide plates 95 be provided such that a space to convey the sheet P is narrowed down from the gloss-imparting device 6 to the pair of conveyance rollers 7. The guide plates 95 correct curling and so forth of the sheet P to guide the leading edge of the sheet P to the direction of conveyance of the sheet P so that wrinkling of the sheet P and sheet jam between the pair of conveyance rollers 7 can be prevented, thereby reliably conveying the sheet P.

The pair of conveyance rollers 7 includes a cylindrical roller 7*a* formed of chloroprene rubber or silicone rubber, and a cylindrical resin roller 7*b* contacting the cylindrical roller 7*a*. Either one or both of the rollers 7*a* and 7*b* is/are rotatively driven so that the sheet P conveyed through the guide plates 95 is sandwiched by the rollers 7*a* and 7*b* to be further conveyed to a discharge path. Here, the pair of conveyance rollers 7 is positioned within 210 mm from the exit of the fixing nip N1 of the fixing device 5. When the sheet P having a length equal to or longer than 210 mm in the direction of conveyance of the sheet P is used during the non-gloss mode, the heating roller 80 and the pressing roller 90 of the gloss-imparting device 6 are separated from each other as described above. However, because the leading edge of the sheet P discharged from the fixing nip N1 of the fixing device 5 reaches the pair of conveyance rollers 7 before the trailing edge of the sheet P is discharged from the fixing nip N1, the sheet P can be appropriately conveyed by the pair of conveyance rollers 7.

Because the temperature on the surface of the heating roller 80 in the gloss-imparting device 6 is set to be rather lower as described above, a temperature of the sheet P reaching the pair of conveyance rollers 7 is equal to or lower than that of the sheet P immediately after discharging from the fixing device 5 during the gloss mode, thereby preventing adhesion of the toner to the pair of conveyance rollers 7 and the guide plates 95.

A description is now given of a configuration of the guide device 20 according to illustrative embodiments.

Figure 3:
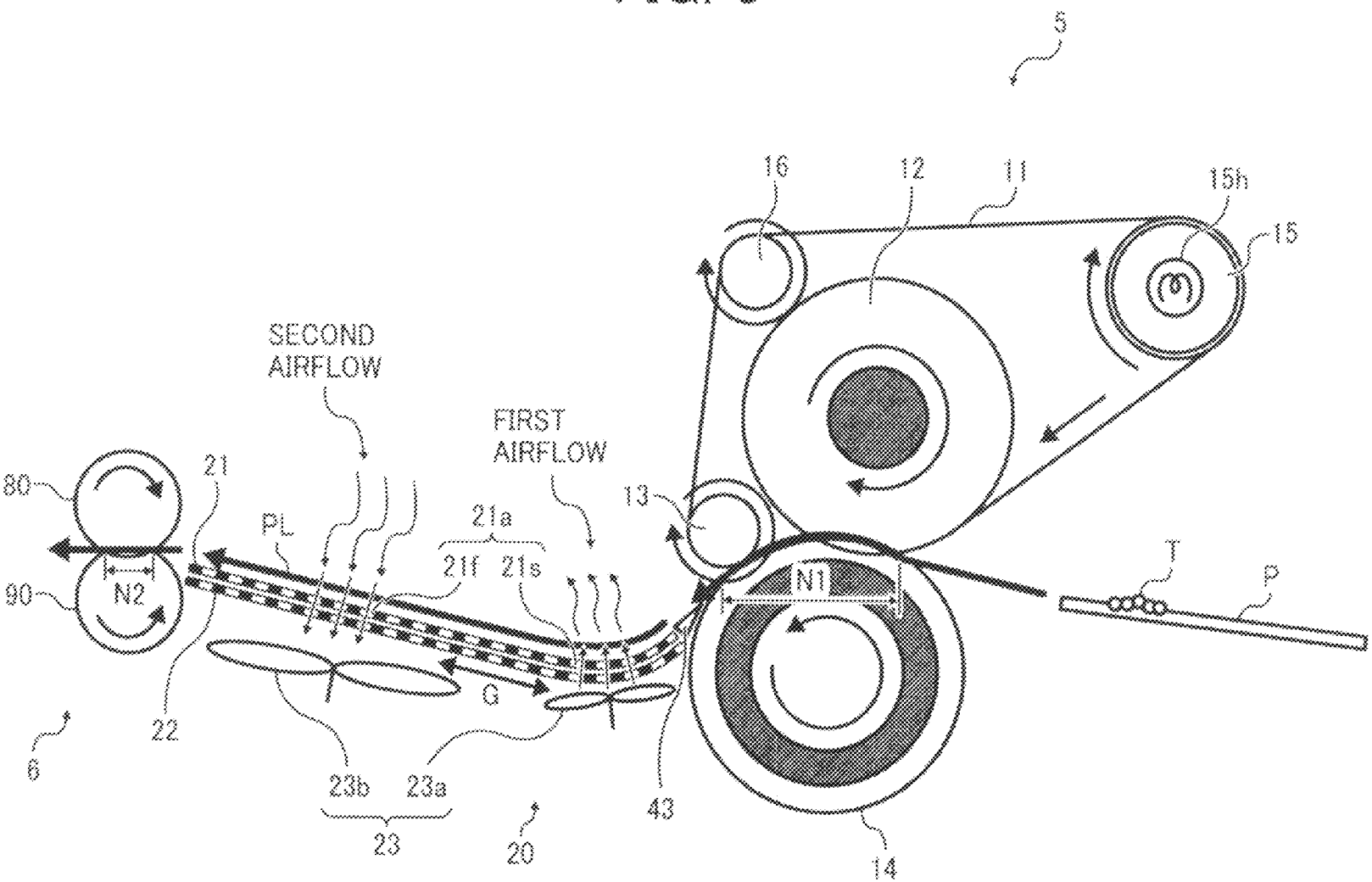
FIG. 3 is a vertical cross-sectional view illustrating main components of the present invention included in the image forming apparatus illustrated in FIG. 1.
Figure 4:
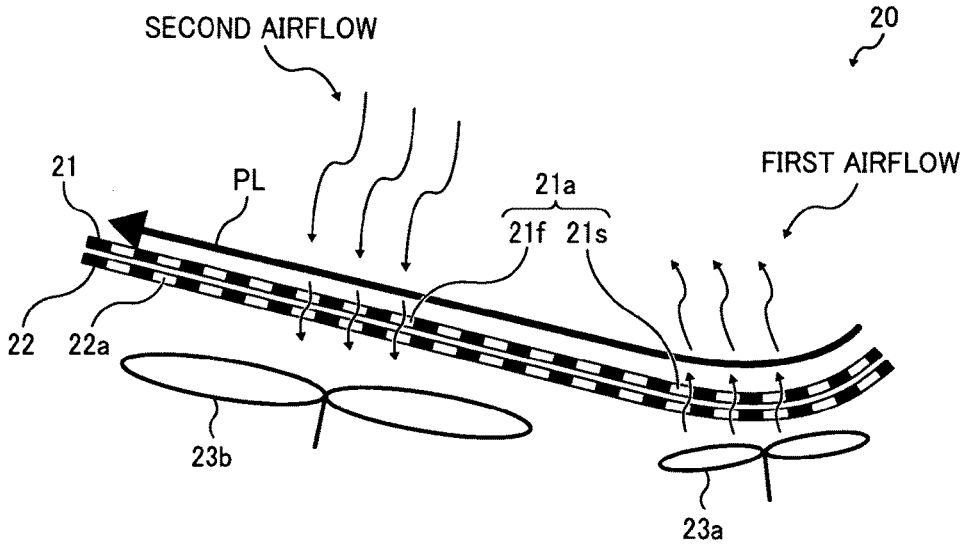
FIG. 4 is a vertical cross-sectional view illustrating a configuration of a guide device according to a first illustrative embodiment.

FIG. 3 is a vertical cross-sectional view illustrating a configuration of main components of the present invention included in the image forming apparatus 100. FIG. 4 is a vertical cross-sectional view illustrating a configuration of the guide device 20 according to a first illustrative embodiment.

The guide device 20 includes the guide member 21 that contacts the sheet P to convey the sheet P from the fixing device 5 to the gloss-imparting device 6 along the conveyance path PL of the sheet P. The guide member 21 is disposed on a side opposite the surface of the sheet P having the toner T fixed thereon by the fixing device 5 along the conveyance path PL of the sheet P, that is, below the conveyance path PL of the sheet P in FIG. 3. The guide device 20 further includes the airflow generator unit 23 that generates an airflow acting, through the guide member 21, on the sheet P passing through the conveyance path PL. The airflow generator unit 23 is disposed on that side of the guide member 21 away from the conveyance path PL of the sheet P, that is, below the guide member 21 in FIG. 3.

The guide member 21 is substantially planar in shape, and positioned along the conveyance path PL of the sheet P. Multiple through-holes 21*a* are formed in the guide member 21 that pass through the guide member 21 from a first surface of the guide member 21 facing the conveyance path PL of the sheet P (hereinafter referred to as an upper surface of the guide member 21) to a second surface of the guide member 21 opposite the first surface (hereinafter referred to as a lower surface of the guide member 21).

In addition to a first airflow generator 23*a* there is also provided a second airflow generator 23*b* that generates a second flow of air from the upper surface of the guide member 21 to the lower surface of the guide member 21 (hereinafter referred to as a second airflow) through some of the multiple through-holes 21*a* (hereinafter collectively referred to as first through-holes 21*f*) provided to the guide member 21 for drawing the sheet P to the guide member 21. The first through-holes 21*f* of the multiple through-holes 21*a* are those provided at a downstream portion of the guide member 21 in the direction of conveyance of the sheet P, for example, at a portion of the guide member 21 in front of the gloss-imparting device 6. Accordingly, the leading edge of the sheet P discharged from the fixing device 5 is drawn to the guide member 21 to correct curling of the sheet P, so that the sheet P appropriately enters in the nip N2 of the gloss-imparting device 6 with a proper shape, thereby preventing sheet jam and folding of the sheet P in the gloss-imparting device 6. It is to be noted that a force of the second airflow generated from the second airflow generator 23*b* may be adjusted based on a degree of curling of the sheet P.

Together, the first airflow generator 23*a* and the second airflow generator 23*b* are collectively referred to as the airflow generator unit 23.

The flow of air generated by the first airflow generator 23*a* goes to the upper surface of the guide member 21 from the lower surface of the guide member 21 (hereinafter referred to as a first airflow) through some of the multiple through-holes 21*a* provided to the guide member 21 (hereinafter collectively referred to as second through-holes 21*s*). The second through-holes 21*s* are provided upstream from the first through-holes 21*f* in the direction of conveyance of the sheet P. Specifically, the second through-holes 21*s* are provided at a portion of the guide member 21 immediately after the fixing device 5. Accordingly, the leading edge of the sheet P discharged from the fixing device 5 is pushed upward, that is, a direction opposite the guide member 21, so that the direction of conveyance of the sheet P discharged from the fixing device 5 can be corrected and the sheet P is appropriately guided to the guide member 21. As a result, collision of the sheet P with the guide member 21 can be prevented or at least minimized, thereby preventing wrinkling of the sheet P and scrapes on the toner image formed on a back side of the sheet P when duplex printing is performed.

It is preferable that the airflow generator unit 23 generate or stop generating the first airflow exiting to the upper surface of the guide member 21 from the lower surface of the guide member 21 through the second through-holes 21*s* depending on the position of the sheet P discharged from the fixing nip N1 of the fixing device 5 relative to the guide member 21. Accordingly, the first airflow acts only on the sheet P likely to collide with the guide member 21, thereby reliably preventing collision of the sheet P with the guide member 21. Alternatively, a force of the first airflow generated from the first airflow generator 23*a* may be adjusted based on the position of the sheet P relative to the guide member 21, which is detected by sensors to be described later.

In a case in which a direction of discharge of the sheet P from the fixing nip N1 of the fixing device 5 is closer to the guide member 21 than a hypothetical straight line connecting the exit of the fixing nip N1 of the fixing device 5 and the entrance of the nip N2 of the gloss-imparting device 6, that is, the fixing nip N1 faces downward and the direction of discharge of the sheet P is lower than the hypothetical straight line, the guide member 21 is concave toward a side opposite the conveyance path PL of the sheet P. In other words, the guide member 21 is downwardly concave in FIG. 3 at a portion near the exit of the fixing nip N1. Consequently, the sheet P tends to be discharged toward the guide member 21, that is, downward, from the fixing nip N1, and is likely to collide with the guide member 21. The first airflow, that is, a jet airflow, generated by the first airflow generator 23*a*, effectively prevents collision of the sheet P with the guide member 21.

As described above, the airflow generator unit 23 includes the first and second airflow generators 23*a* and 23*b*, so that the first and second airflow generators 23*a* and 23*b* are individually driven to generate or stop generating the airflow through the first and second through-holes 21*f* and 21*s*.

Although the first airflow is a jet airflow and the second airflow is a suction airflow as described above according to the first illustrative embodiment, alternatively, different types of airflows may be used as the first or second airflow. For example, when the trailing edge of the sheet P passes through the fixing nip N1, tension is released from the sheet P. Consequently, the sheet P is fluttered and vibrated while passing through the conveyance path PL of the sheet P, and as a result, collides with the components disposed around the conveyance path PL of the sheet P, possibly damaging the sheet P and the toner image formed thereon. In such a case, the suction airflow is generated as both the first and second airflows to draw the sheet P to the guide member 21, thereby preventing deviation of the sheet P from the conveyance path PL of the sheet P and damages of the sheet P and the toner image.

It is preferable that the airflow generator unit 23 include an airflow control mechanism capable of controlling the airflow throughout the guide member 21 or individually controlling the airflow for each of multiple sections of the guide member 21.

Figure 5A:
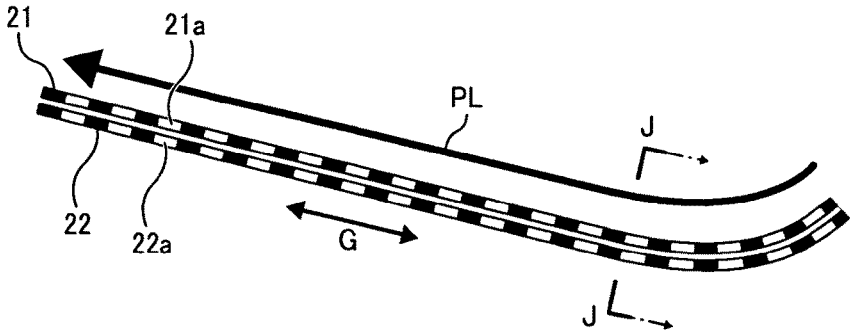
FIG. 5A is a vertical cross-sectional view illustrating relative positions of a guide member and a shielding member included in the guide device illustrated in FIG. 4.
Figure 5B:
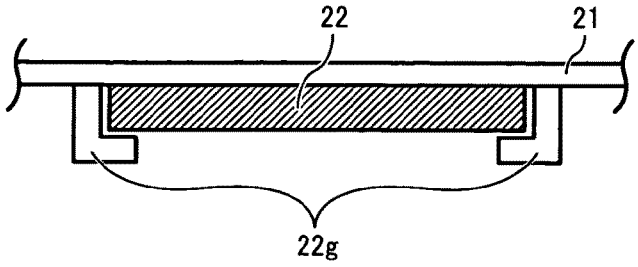
FIG. 5B is a vertical cross-sectional view illustrating the relative positions of the guide member and the shielding member cut along a line J-J in FIG. 5A.

A description is now given of an example of such an airflow control mechanism according to illustrative embodiments. FIG. 5A is a vertical cross-sectional view illustrating relative positions of the guide member 21 and a shielding member 22 serving as the airflow control mechanism according to illustrative embodiments. FIG. 5B is a vertical cross-sectional view illustrating the relative positions of the guide member 21 and the shielding member 22 cut along a line J-J in FIG. 5A.

The shielding member 22 is movable so as to be able to cover or uncover the multiple through-holes 21*a* of the guide member 21. Specifically, the shielding member 22 covers the multiple through-holes 21*a* throughout the guide member 21 or for each of the multiple sections of the guide member 21 in order to close the multiple through-holes 21*a*, or uncovers the multiple through-holes 21*a* throughout the guide member 21 or for each of the multiple sections of the guide member 21 in order to open the multiple through-holes 21*a*.

As illustrated in FIG. 5A, the shielding member 22 is disposed on the side of the guide member 21 away from the conveyance path PL of the sheet P that is, below the guide member 21, and has a substantially planar shape and is disposed along the conveyance path PL of the sheet P. The shielding member 22 includes multiple through-holes 22*a* that penetrate the shielding member 22 from a first surface or side on the conveyance path PL of the sheet P (hereinafter referred to as an upper surface of the shielding member 22) to a second surface or side opposite the first surface of the shielding member 22 (hereinafter referred to as a lower surface of the shielding member 22). The multiple through-holes 22*a* are provided corresponding to the multiple through-holes 21*a* of the guide member 21.

As illustrated in FIG. 5B, the shielding member 22 is slidably supported by guide parts 22*g* provided along both edges of the guide member 21 in the width direction of the sheet P. The shielding member 22 is slid by a driving means, not shown, along the conveyance path PL of the sheet P, that is, directions indicated by a double-headed arrow G in FIGS. 3 and 5A, so that the through-holes 21*a* of the guide member 21 are opened or closed by the shielding member 22.

Figure 6A:
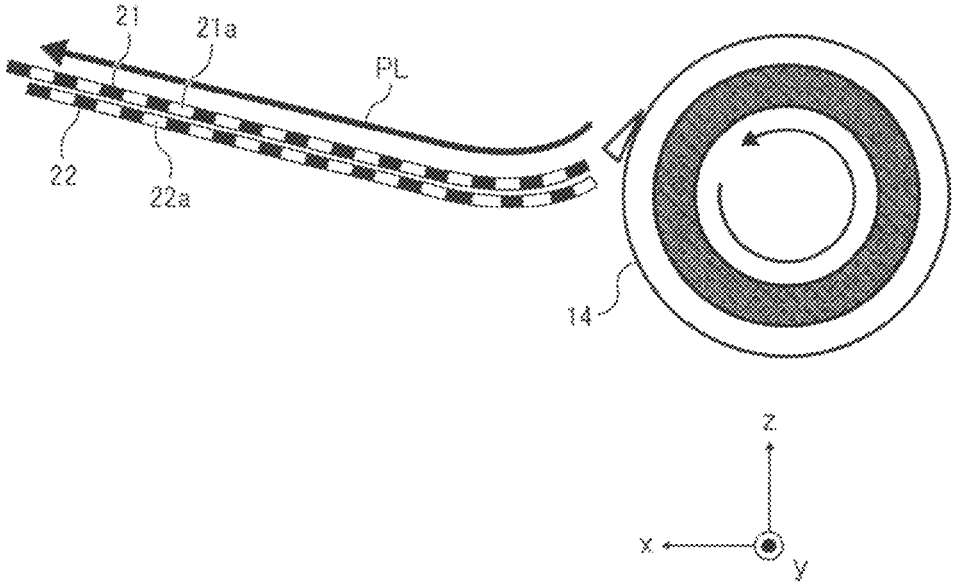
FIG. 6A is a vertical cross-sectional view illustrating a state in which through-holes of the guide member included in the guide device illustrated in FIG. 4 are closed.
Figure 6B:
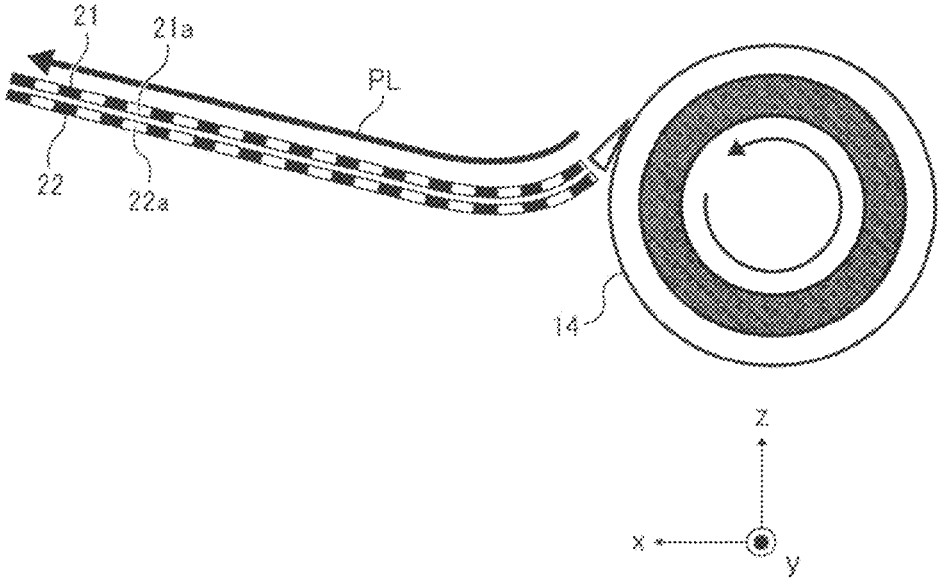
FIG. 6B is a vertical cross-sectional view illustrating a state in which the through-holes of the guide member included in the guide device illustrated in FIG. 4 are opened.

FIG. 6A is a vertical cross-sectional view illustrating a state in which the shielding member 22 closes (covers) the multiple through-holes 21*a* throughout the guide member 21, and FIG. 6B is a vertical cross-sectional view illustrating a state in which the shielding member 22 opens (uncovers) the multiple through-holes 21*a* throughout the guide member 21. As illustrated in FIG. 6A, positions of the through-holes 22*a* are completely offset from those of the through-holes 21*a* on a plane surface X-Z in FIG. 6A to close the through-holes 21*a*. By contrast, as illustrated in FIG. 6B, the positions of the through-holes 22*a* are the same as those of the through-holes 21*a* on a plane surface X-Z in FIG. 6B to open the through-hole 21*a*. The through-holes 21*a* are opened or closed by adjusting an amount of sliding of the shielding member 22, and the amount of sliding of the shielding member 22 is, for example, equal to or greater than a half of a diameter of either the through-hole 21*a* of the guide member 21 or the through-hole 22*a* of the shielding member 22 in the direction of conveyance of the sheet P.

Figure 7:
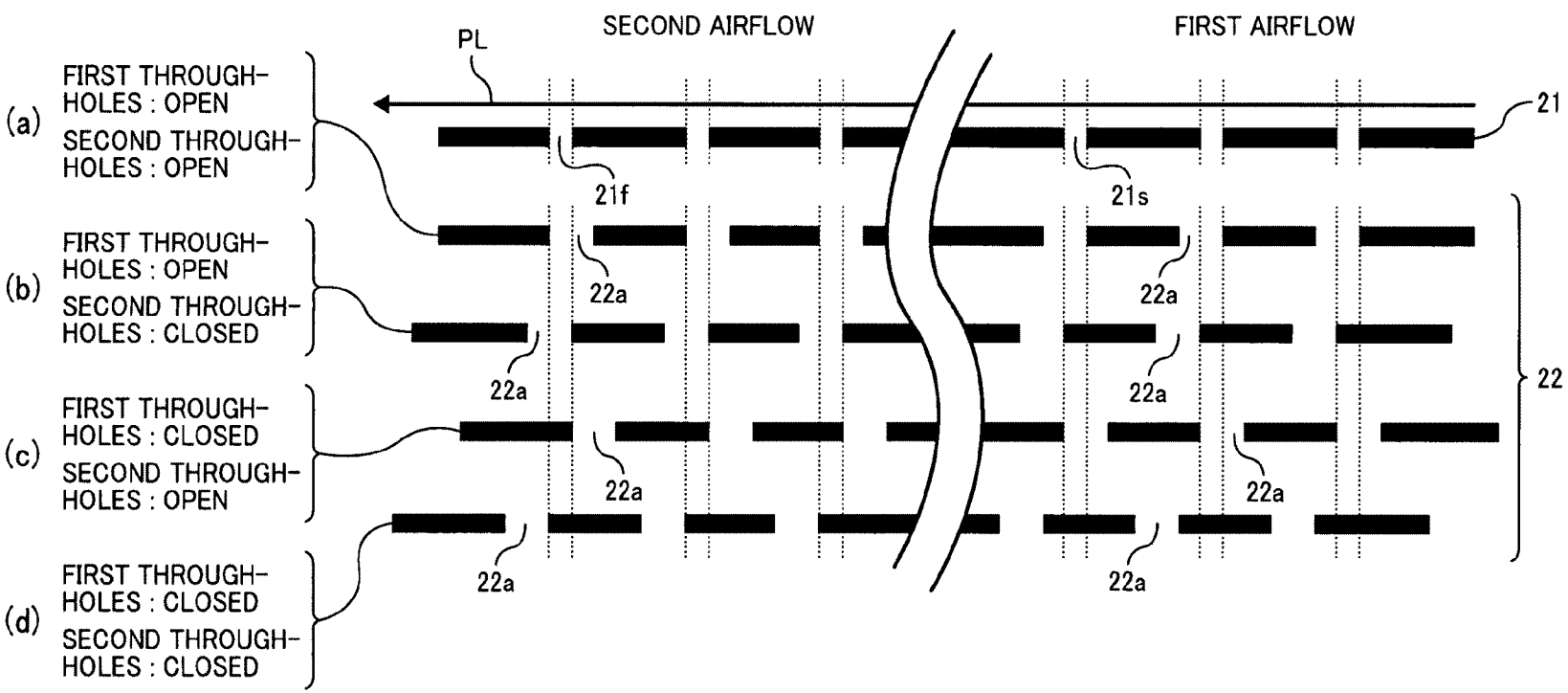
FIG. 7 is a view illustrating different combinations of open and closed first and second through-holes of the guide member included in the guide device illustrated in FIG. 4.

A diameter of each of the through-holes 22*a* or a pattern of the positions of the through-holes 22*a* on the shielding member 22 in the direction of conveyance of the sheet P are adjusted to differ open/close conditions of the first and second through-holes 21*f* and 21*s*. FIG. 7 is a view illustrating examples of patterns of the open/close conditions of the first and second through-holes 21*f* and 21*s* controlled by the shielding member 22 for each of the multiple sections of the guide member 21 in the direction of conveyance of the sheet P. In FIG. 7, a diameter of each of the through-holes 22*a* in the direction of conveyance of the sheet P is twice as long as a diameter of each of the through-holes 21*a*, and the positions of the through-holes 22*a* are differed a predetermined distance among each of the multiple sections corresponding to the first and second through-holes 21*f* and 21*s* of the guide member 21 in the direction of conveyance of the sheet P. Accordingly, the shielding member 22 is slid by a distance of the single through-hole 21*a* in the direction of conveyance of the sheet P to differ the open/close conditions of the first and second through-holes 21*f* and 21*s* as illustrated in FIG. 7. For example, FIG. 7(*a*) illustrates a state in which both of the first and second through-holes 21*f* and 21*s* are opened. FIG. 7(*b*) illustrates a state in which the first through-holes 21*f* are opened and the second through-holes 21*s* are closed. FIG. 7(*c*) illustrates a state in which the first through-holes 21*f* are closed and the second through-holes 21*s* are opened. FIG. 7(*d*) illustrates a state in which both of the first and second through-holes 21*f* and 21*s* are closed. As a result, the first and second airflows are caused to act on or not to act on the sheet P, individually.

Figure 8:
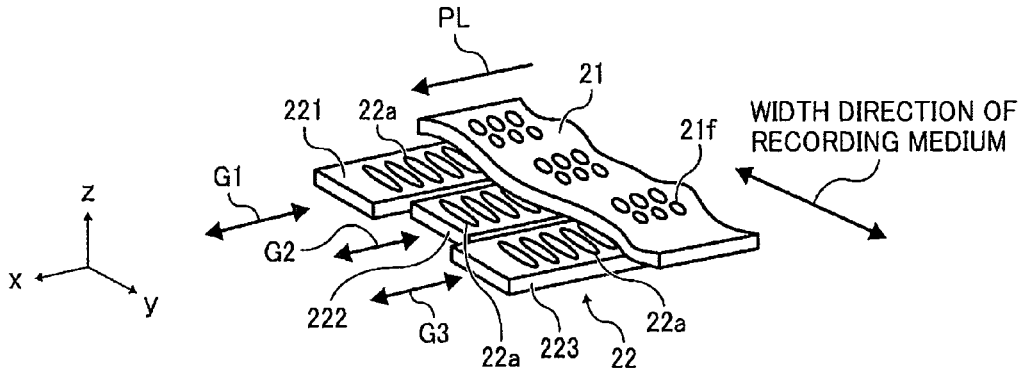
FIG. 8 is an enlarged perspective view illustrating an example of a configuration of the shielding member included in the guide device illustrated in FIG. 4.

The shielding member 22 for the first through-holes 21*f* is separated into three parts in the width direction of the sheet P as illustrated in FIG. 8. Specifically, the shielding member 22 for the first through-holes 21*f* includes a plate 222 provided at the center of the shielding member 22 in the width direction of the sheet P, and plates 221 and 223 provided on both sides of the plate 222. It is preferable that the plates 221, 222, and 223 individually switch the open/close conditions of the first through-holes 21*f*.

FIG. 8 is an enlarged perspective view illustrating an example in which the shielding member 22 switches the open/close conditions of the first through-holes 21*f* for each of the multiple sections of the guide member 21 in the width direction of the sheet P.

In FIG. 8, each of the plates 221, 222, and 223 has the multiple through-holes 22*a*, and is individually slid along the conveyance path PL of the sheet P, that is, directions indicated by double-headed arrows G1, G2, and G3, respectively, to cause the second airflow to act on the sheet P based on a degree of curling of the sheet P. Specifically, in a case in which only edges of the sheet P is curled up toward a direction opposite the guide member 21, that is, an upward direction, the plates 221 and 223 are slid such that positions of the through-holes 22*a* on the plates 221 and 223 are the same as the positions of the first through-holes 21*f* of the guide member 21 on a plane surface X-Z in FIG. 8. In addition, the plate 222 is slid such that positions of the through-holes 22*a* of the plate 222 are offset from the positions of the first through-holes 21*f* of the guide member 21 on the plane surface X-Z in FIG. 8. Accordingly, the suction air generated by the second air generator 23*b* can act only on the edges of the sheet P to correct the curling of the sheet P.

By contrast, in a case in which a center portion of the sheet P is curled up toward the direction opposite the guide member 21, that is, an upward direction, the plates 221 and 223 are slid such that the positions of the through-holes 22*a* on the plates 221 and 223 are offset from the positions of the first through-holes 21*f* on the guide member 21 on the plane surface X-Z in FIG. 8. In addition, the plate 222 is slid such that the positions of the through-holes 22*a* on the plate 222 are the same as the positions of the first through-holes 21*f* on the guide member 21 on the plane surface X-Z in FIG. 8. Accordingly, the curling at the center portion of the sheet P can be corrected. As a result, wrinkling of the sheet P or sheet jam caused by a difference in a conveyance velocity between different parts of the sheet P due to too much suction to a portion without curling, such as the edges or the center portion of the sheet P, can be prevented using the single guide member 21 as described above.

It is to be noted that, in a case in which the sheet P is evenly curled up in the width direction thereof, the plates 221, 222, and 223 are slid such that the positions of all the through-holes 22*a* on the plates 221, 222, and 223 are the same as, or offset from, the positions of the first through-holes 21*f* on the guide member 21 on the plane surface X-Z in FIG. 8.

As described above, FIG. 8 illustrates the example in which the shielding member 22 is separated into the three parts, that is, the plates 221, 222, and 223, in the width direction of the sheet P to individually control the second airflow for the three parts corresponding to the multiple sections of the guide member 21 in the width direction of the sheet P. Alternatively, however, the number of parts of the shielding member 22, that is, the number of sections of the guide member 21 to individually control the second airflow in the width direction of the sheet P, is not particularly limited, and the number may be appropriately set depending on the degree of curling of the sheet P.

It is preferable that the degree of curling itself of the sheet P be detected either by sensors, to be described in detail later, or is determined based on a thickness of the sheet P.

In a case in which the degree of curling of the sheet P is determined based on a thickness of the sheet P, relations of a thickness of the sheet P, presence or non-presence of curling, and shapes of the curling are obtained in advance to determine the degree of curling of the sheet P based on the relations thus obtained. For example, when the sheet P is thinner than a predetermined thickness, it is determined that large curls are generated on both edges of the sheet P in the width direction of the sheet P. By contrast, when the sheet P is thicker than a predetermined thickness, it is determined that curls are not generated on the sheet P. It is to be noted that in the fixing device 5 illustrated in FIG. 2 in which the fixing nip N1 includes the two nips formed between the pressure roller 14 and the fixing roller 12 and between the pressure roller 14 and the separation roller 13, respectively, curling tends to occur at both edges of the sheet P in the width direction of the sheet P.

Figure 9A:
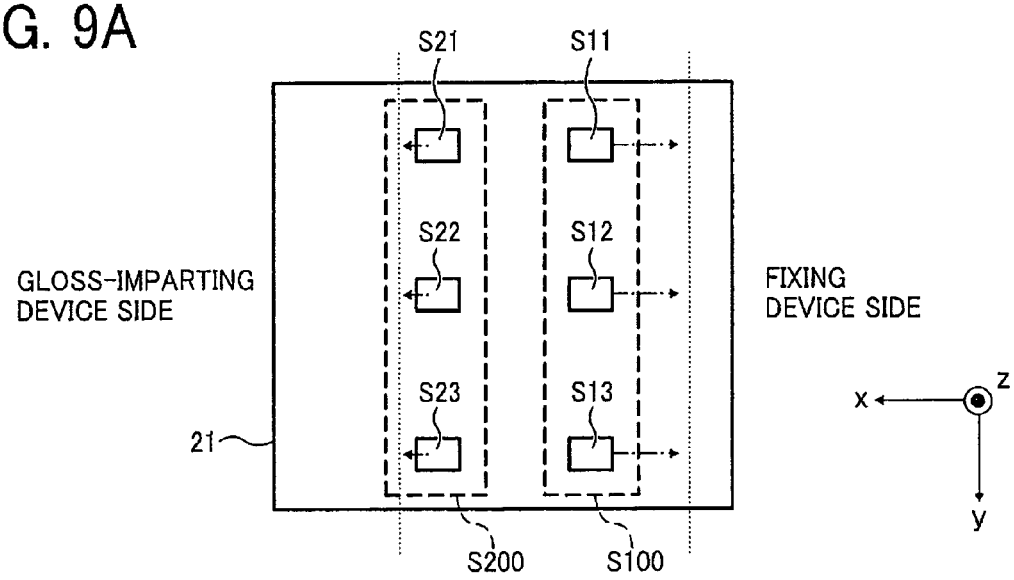
FIG. 9A is a top view illustrating a configuration of multiple sensor groups disposed in the guide device illustrated in FIG. 4.
Figure 9B:
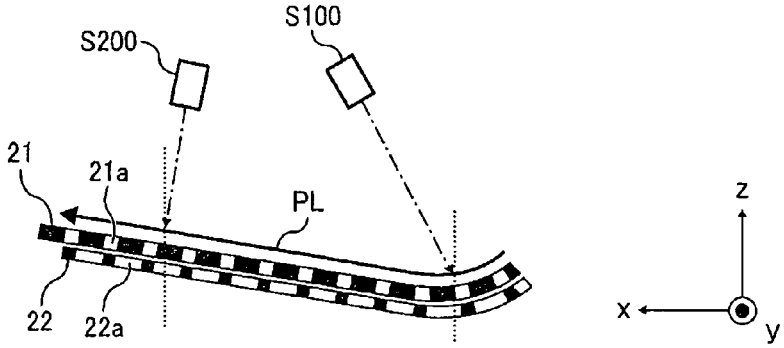
FIG. 9B is a vertical cross-sectional view illustrating the configuration of the multiple sensor groups disposed in the guide device illustrated in FIG. 4.

A description is now given of a case in which the degree of curling is detected by sensors, with reference in the first instance to FIGS. 9A and 9B.

FIGS. 9A and 9B are a top view and a vertical cross-sectional view, respectively, illustrating a configuration of a plurality of sensor groups disposed in the guide device 20.

That is, the guide device 20 includes a first sensor group S100 having multiple sensors provided closer to the exit of the fixing device 5 and a second sensor group S200 having multiple sensors provided closer to the entrance of the gloss-imparting device 6. Each of the sensors included in the first and second sensor groups S100 and S200 is a range sensor that emits light and detects reflective light to measure a distance.

The first sensor group S100 detects a height of the sheet P from the guide member 21 when the sheet P is conveyed at a point of intersection of the conveyance path PL of the sheet P and the first airflow. As illustrated in FIG. 9A, the first sensor group S100 includes sensors S11, S12, and S13, such that the height of the sheet P from the guide member 21 can be detected at three different positions in a width direction of the conveyance path PL of the sheet P, that is, a y-axis direction in FIG. 9A.

The second sensor group S200 detects a height of the sheet P from the guide member 21 when the sheet P is conveyed at a point of intersection of the conveyance path PL of the sheet P and the second airflow. As illustrated in FIG. 9A, the second sensor group S200 includes sensors S21, S22, and S23, such that the height of the sheet P from the guide member 21 can be detected at three different positions in the width direction of the conveyance path PL of the sheet P, that is, the y-axis direction in FIG. 9A.

A description is now given of a method for controlling the guide device 20 using the first sensor group S100. Basically, the shielding member 22 is moved so as to cover and uncover the through-holes 21*a* in the guide member 21 in order to adjust the type and strength of generated airflows depending on the height of the sheet P off the guide member 21 as measured by the sensors.

Figure 10:
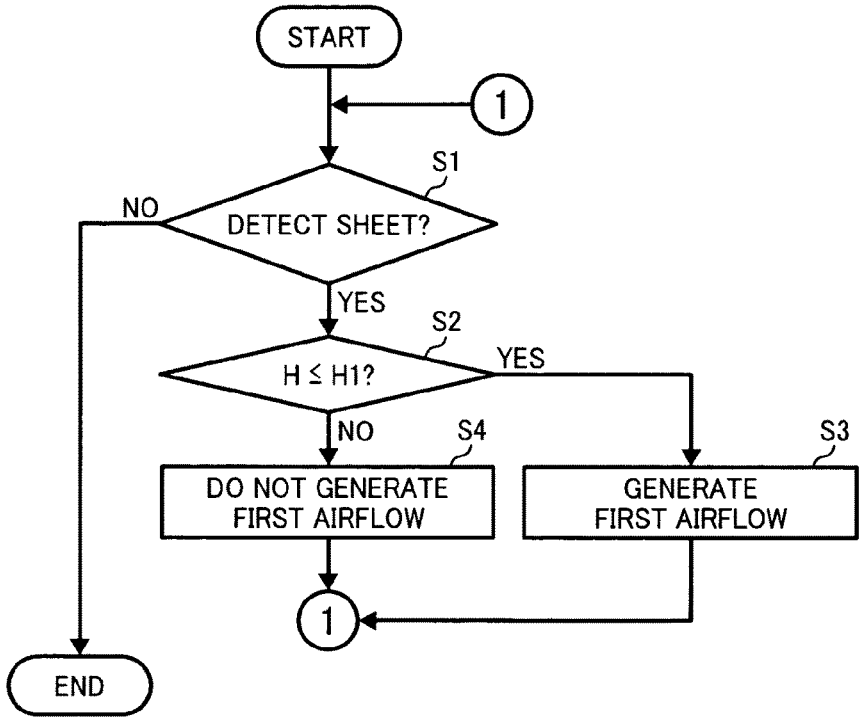
FIG. 10 is a flowchart illustrating operations of the guide device to control a first airflow using a first sensor group.

FIG. 10 is a flowchart illustrating operations of the guide device 20 when the sheet P enters the point of intersection of the first airflow and the conveyance path PL of the sheet P. It is to be noted that when the height of the sheet P from the guide member 21 detected by the first sensor group S100 is equal to or less than a threshold height H1, the sheet P is likely to collide with the guide member 21. The threshold height H1 is obtained by multiplying an average height Hs of the sheet P from the guide member 21 by a value a that is adjusted based on usage environment and conditions of the guide device 20.

When printing is requested and image formation is started, at step S1 the first sensor group S100 starts detection of the sheet P. When the first sensor group S100 detects the sheet P (YES at step S1), the process proceeds to step S2 to determine a degree of deviation of the sheet P in a vertical direction from the guide member 21 based on the height H of the sheet P from the guide member 21 detected by each of the sensors S11, S12, and S13 included in the first sensor group S100. Specifically, when all the heights H (or an average value of the heights H) detected by the sensors S11, S12, and S13 are equal to or smaller than the threshold height H1 (YES at step S2), the process proceeds to step S3 so that the shielding member 22 opens the second through-holes 21*s* to generate the jet airflow from the first airflow generator 23*a* of the airflow generator unit 23.

By contrast, when the heights H (or an average value of the heights H) detected by the sensors S11, S12, and S13 are not equal to or smaller than the threshold height H1 (NO at step S2), the process proceeds to step S4 so that the shielding member 22 closes the second through-holes 21*s* and the jet airflow is not generated from the first airflow generator 23*a* of the airflow generator unit 23.

The above-described processes are repeated until the first sensor group S100 does not detect the sheet P.

The direction of conveyance of the sheet P at the exit of the fixing nip N1 of the fixing device 5 is determined as described above. Accordingly, the first airflow is caused to appropriately act on the sheet P that is likely to collide with the guide member 21, thereby preventing collision of the sheet P with the guide member 21.

A description is now given of a method for controlling the guide device 20 using the second sensor group S200.

Figure 11:
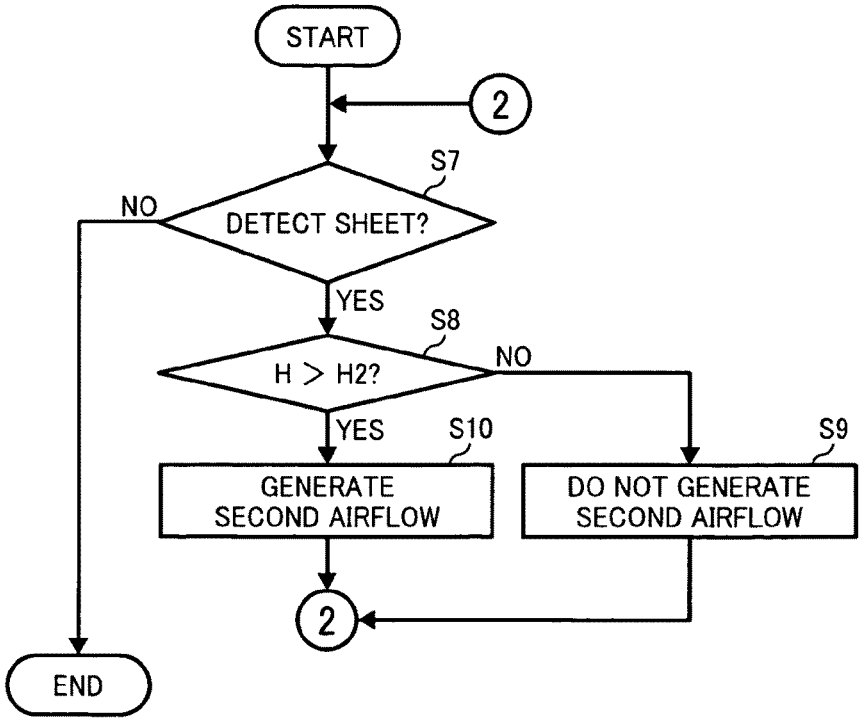
FIG. 11 is a flowchart illustrating operations of the guide device to control a second airflow using a second sensor group.

FIG. 11 is a flowchart illustrating operations of the guide device 20 when the sheet P enters the point of intersection of the second airflow and the conveyance path PL of the sheet P. It is to be noted that when the height of the sheet P from the guide member 21 detected by the second sensor group S200 is greater than a threshold height H2, the sheet P is likely to have curling. The threshold height H2 is obtained by multiplying an average height Hs' of the sheet P from the guide member 21 by a value β that is adjusted based on usage environment and conditions of the guide device 20.

When printing is requested and image formation is started, at step S7 the second sensor group S200 starts detection of the sheet P. When the second sensor group S200 detects the sheet P (YES at step S7), the process proceeds to step S8 to determine a degree of curling of the sheet P based on the height H of the sheet P from the guide member 21 detected by each of the sensors S21, S22, and S23 included in the second sensor group S200. Specifically, when any one of the heights H detected by the sensors S21, S22, and S23 is greater than the threshold height H2 (YES at step S8), the process proceeds to step S10 so that the plates 221, 222, or 223 corresponding to a detecting position of the corresponding sensor S21, S22, or S23 is slid to open the first through-holes 21*f* of that section to cause the suction airflow generated by the second airflow generator 23*b* of the airflow generator unit 23 to act on the sheet P. By contrast, when the heights H detected by the sensors S11, S12, and S13 are not greater than the threshold height H2 (NO at step S8), the process proceeds to step S9 so that one of the plates 221, 222, or 223 corresponding to a detecting position of the corresponding sensor S21, S22, or S23 is slid to close the first through-holes 21*f* of that section to cause the second airflow generator 23*b* of the airflow generator unit 23 not to generate the suction airflow.

The above-described processes are repeated until the second sensor group S200 does not detect the sheet P.

The degree of curling of the sheet P at the entrance of the nip N2 of the gloss-imparting device 6 is determined as described above. Accordingly, the second airflow is caused to appropriately act on the sheet P that is likely to have curling, thereby causing the sheet P to enter the nip N2 with an appropriate shape.

It is to be noted that the airflow generator unit 23 is not limited to the configuration illustrated in FIG. 4. Accordingly, a description is now given of a second illustrative embodiment of the airflow generator unit 23 and the airflow control mechanism included in the guide device 20.

Figure 12A:
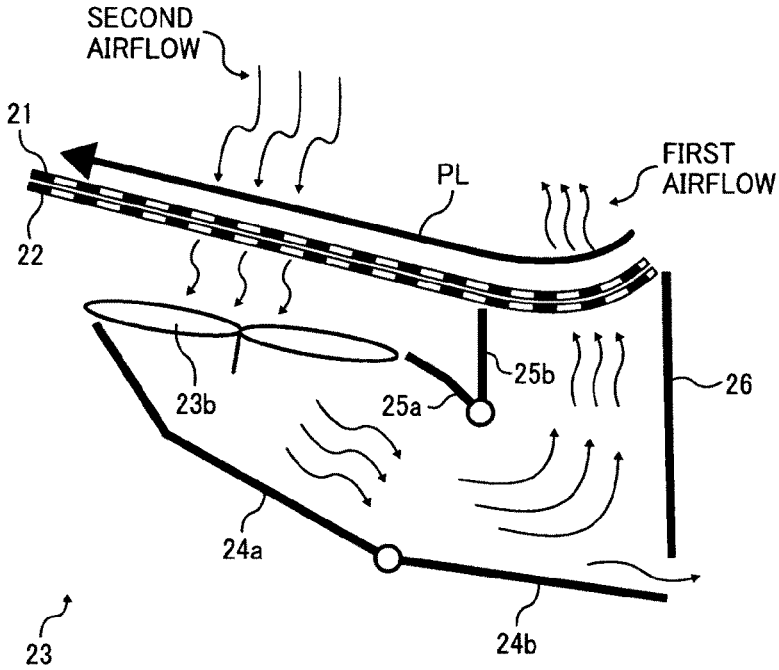
FIGS. 12A and 12B are vertical cross-sectional views respectively illustrating a configuration of an airflow generator unit included in a guide device according to a second illustrative embodiments.
Figure 12B:
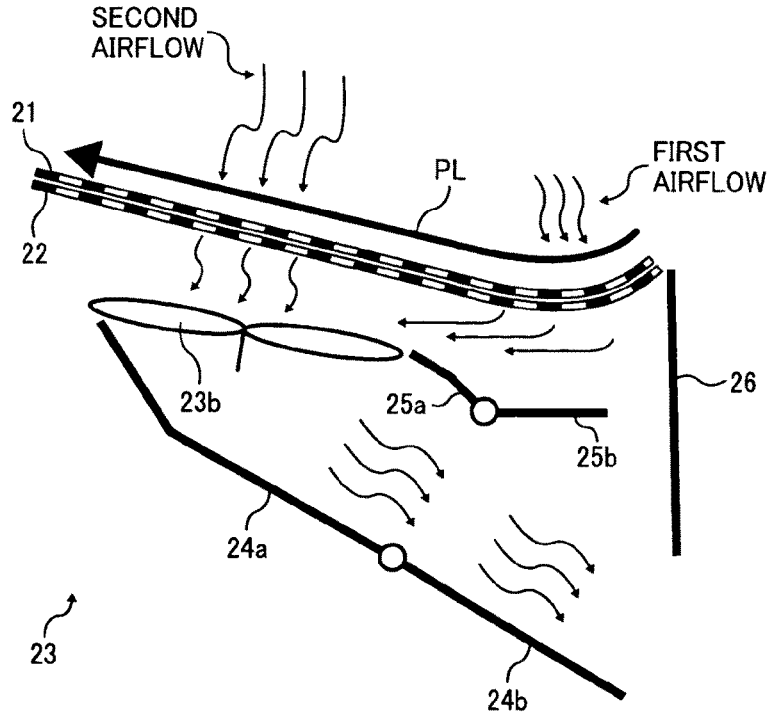

FIGS. 12A and 12B are vertical cross-sectional views respectively illustrating the airflow generator unit 23 and the airflow control mechanism controlling the airflow for each of the multiple sections of the guide member 21 in the direction of conveyance of the sheet P according to the second illustrative embodiment. Specifically, in FIG. 12A, a jet airflow is generated as the first airflow, and a suction airflow is generated as the second airflow. In FIG. 12B, both of the first and second airflows are suction airflows.

The airflow generator unit 23 according to the second illustrative embodiment includes the second airflow generator 23*b* provided to generate the second airflow, walls 24*a* and 25*a* each provided at a portion where the second airflow generated by the second airflow generator 23*b* is discharged, a wall 26 provided on the lower surface side of the guide member 21 on the fixing device 5 side, and airflow adjustment valves 24*b* and 25*b* each adjusting a flow of the second airflow generated by the second airflow generator 23*b*.

In FIG. 12A, the airflow adjustment valve 24*b* is disposed such that most of the second airflow discharged from the second airflow generator 23*b* flows toward the second through-holes 21*s*, and the airflow adjustment valve 25*b* is disposed such that the first and second airflows are separated from each other on the lower surface side of the guide member 21. Accordingly, when the second airflow generator 23*b* generates a suction airflow as the second airflow, the first airflow becomes a jet airflow.

In FIG. 12B, the airflow adjustment valve 24*b* is disposed such that the second airflow discharged from the second airflow generator 23*b* flows outside the guide device 20, and the airflow adjustment valve 25*b* is disposed such that the partition between the first and second airflows on the lower surface side of the guide member 21 is removed. Accordingly, when the second airflow generator 23*b* generates a suction airflow as the second airflow, the first airflow becomes a suction airflow.

It is to be noted that the airflow generator unit 23 is not limited to the configuration illustrated in FIG. 8.

A description is now given of the airflow generator unit 23 and the airflow control mechanism included in the guide device 20 according to a third illustrative embodiment.

Figure 13:
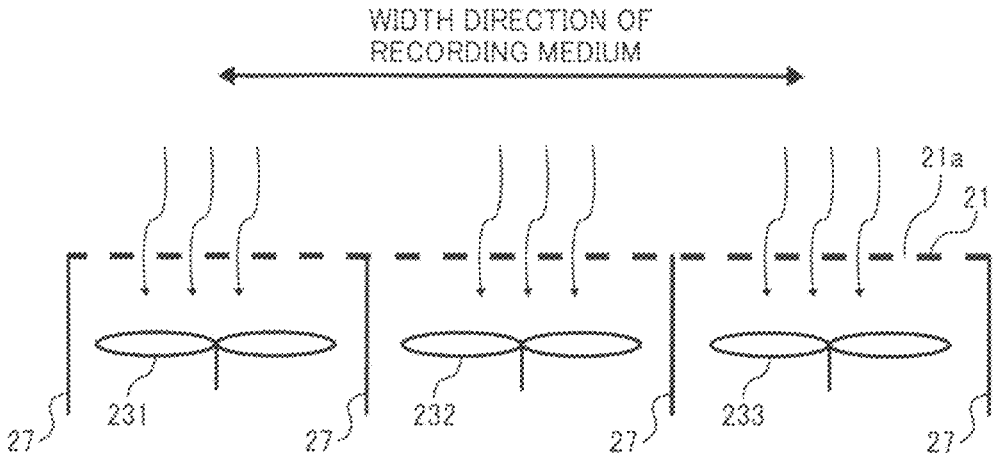
FIG. 13 is a vertical cross-sectional view illustrating a configuration of an airflow generator unit included in a guide device according to a third illustrative embodiment.

FIG. 13 is a vertical cross-sectional view illustrating the airflow generator unit 23 and the airflow control mechanism controlling the airflow for each of the multiple sections of the guide member 21 in the width direction of the sheet P according to the third illustrative embodiment.

In FIG. 13, a part for generating the second airflow is divided into three sections in the width direction of the sheet P on the lower surface side of the guide member 21 by partitions 27, and airflow generators 231, 232, and 233 are provided in the three sections, respectively. Each of the airflow generators 231, 232, and 233 generates a suction airflow as the second airflow through the first through-holes 21*f*. Accordingly, the suction airflow is caused to act on the sheet P passing through the guide member 21 based on the degree of curling of the sheet P, thereby appropriately correcting the curling of the sheet P.

A description is now given of image forming processes performed by the image forming apparatus according to illustrative embodiments.

In the image forming apparatus 100, the gloss mode and the non-gloss mode are selectable using the sheets P having the same weight. For example, the gloss mode or the non-gloss mode may be selected by a user through a screen displayed on a monitor of the image forming apparatus 100. In the gloss mode, the sheet P having a high degree of glossiness in a range between 30% and 50% such as coated paper is used to form the toner image thereon, and glossiness with a degree same as that of the sheet P is imparted to the toner image. The gloss mode is preferably used for photogravure printing. By contrast, in the non-gloss mode, the sheet P without a high degree of glossiness such as plain paper is used to form the toner image thereon, and glossiness is not imparted to the toner image. Here, the degree of glossiness (%) is measured by a 60° glossmeter.

When the gloss mode is selected, the following processes are performed by the image forming apparatus 100 using the sheet P such as coated paper having a degree of glossiness in a range between 30% and 50%. It is to be noted that the processes to be described in detail below are performed by the configuration illustrated in FIG. 2.

First, the sheet P having the unfixed toner T thereon is conveyed to the fixing device 5 so that the toner T is fixed to the sheet P. At this time, the fixing belt 11 is heated to a temperature appropriate for fixing the toner T to the sheet P by heat generated by the heater 15*h* provided within the heat roller 15. With regard to an amount of pressure at the fixing nip N1, the cam 78 is adjusted such that a half or more of all the width of the fixing nip N1 has a pressure in a range between 15 N/cm$^2$ and 30 N/cm$^2$. Accordingly, the toner T on the sheet P after passing through the fixing device 5 is completely fixed to the sheet P, and the degree of glossiness of 25% or greater is imparted to the toner T.

Curling and so forth of the sheet P discharged from the fixing device 5 are corrected by the guide device 20, and the leading edge of the sheet P is appropriately guided to the gloss-imparting device 6.

Glossiness is further imparted to the toner image on the sheet P by the gloss-imparting device 6. At this time, a temperature on the surface of the heating roller 80 is set in a range between 80 C.° and 100 C.°, and a pressure at the nip N2 is adjusted by the pressure adjustment means in a range between 15 N/cm$^2$ and 30 N/cm$^2$. Accordingly, when the sheet P passes through the gloss-imparting device 6, heat and a predetermined amount of pressure are applied to the fixed toner image on the sheet P at the nip N2, and the surface layer of the fixed tone image is leveled. As a result, a degree of glossiness of within ±15%, and more preferably within ±10%, relative to the degree of glossiness of the sheet P, is imparted to the fixed toner image. The sheet P discharged from the gloss-imparting device 6 is then conveyed through the guide plates 95, and is discharged from the image forming apparatus 100 through, the pair of conveyance rollers 7.

By contrast, when the non-gloss mode is selected, first, it is confirmed whether the sheet P has a length shorter than 210 mm in the direction of conveyance of the sheet P or a length equal to or longer than 210 mm in the direction of conveyance of the sheet P.

In a case in which the length of the sheet P in the direction of conveyance of the sheet P is shorter than 210 mm during the non-gloss mode, the sheet P having the unfixed toner T thereon is conveyed to the fixing device 5 to fix the toner T to the sheet P. At this time, the fixing belt 11 is heated to a temperature appropriate for fixing the toner T to the sheet P by heat generated by the heater 15*h* provided within the heat roller 15. With regard to an amount of pressure at the fixing nip N1, the cam 78 is adjusted such that less than a half of all the width of the fixing nip N1 has a pressure in a range between 15 N/cm$^2$ and 30 N/cm$^2$. Accordingly, the toner T on the sheet P after passing through the fixing device 5 is completely fixed to the sheet P while glossiness of the toner T is not increased. Alternatively, the conditions of the fixing device 5 may be set in the manner same as those in the gloss mode depending on the type of the sheet P used.

Curling and so forth of the sheet P discharged from the fixing device 5 are corrected by the guide device 20, and the leading edge of the sheet P is appropriately guided to the gloss-imparting device 6.

In the gloss-imparting device 6, the sheet P is sandwiched between the heating roller 80 and the pressing roller 90 at the nip N2 to be conveyed. At this time, a temperature on the surface of the heating roller 80 is set in a range between 80 C.° and 100 C.°, and a pressure at the nip N2 is adjusted by the pressure adjustment means to be lower than that during the gloss mode. For example, the pressure at the nip N2 during the non-gloss mode is set to 5 N/cm$^2$ or lower. Accordingly, when the sheet P passes through the gloss-imparting device 6, heat and pressure are not applied to the fixed toner image on the sheet P at the nip N2, thereby not increasing glossiness of the fixed toner image. The sheet P discharged from the gloss-imparting device 6 is then conveyed through the guide plates 95, and is discharged from the image forming apparatus 100 through the pair of conveyance rollers 7.

In a case in which the non-gloss mode is selected and the length of the sheet P in the direction of conveyance of the sheet P is equal to or longer than 210 mm, first, the sheet P having the unfixed toner T thereon is conveyed to the fixing device 5 to fix the toner T to the sheet P. At this time, the fixing belt 11 is heated to a temperature appropriate for fixing the toner T to the sheet P by heat generated by the heater 15*h* provided within the heat roller 15. With regard to an amount of pressure at the fixing nip N1, the cam 78 is adjusted such that less than a half of all the width of the fixing nip N1 has a pressure in a range between 15 N/cm$^2$ and 30 N/cm$^2$. Accordingly, the toner T on the sheet P after passing through the fixing device 5 is completely fixed to the sheet P while glossiness of the toner T is not increased.

Curling and so forth of the sheet P discharged from the fixing device 5 are corrected by the guide device 20, and the leading edge of the sheet P is appropriately guided to the gloss-imparting device 6.

In the gloss-imparting device 6, the heating roller 80 and the pressing roller 90 are separated from each other such that a gap therebetween is equal to or shorter than 2 mm, and the sheet P passes therebetween. The sheet P passing through the gloss-imparting device 6 is then conveyed to the pair of conveyance rollers 7 through the guide plates 95. The pair of conveyance rollers 7 is positioned within 210 mm from the exit of the fixing nip N1 of the fixing device 5. Therefore, the leading edge of the sheet P discharged from the fixing nip N1 of the fixing device 5 reaches the pair of conveyance rollers 7 before the trailing edge of the sheet P is discharged from the fixing nip N1. Accordingly, the sheet P is sandwiched by the pair of conveyance rollers 7 and is appropriately conveyed. The sheet P discharged from the pair of conveyance rollers 7 is then discharged from the image forming apparatus 100 through the discharge path.

As described above, in the non-gloss mode, the sheet P is reliably conveyed without increasing the degree of glossiness of the toner image in the fixing device 5 and the gloss-imparting device 6 regardless of the size of the sheet P. Accordingly, the toner image with a desired degree of glossiness can be formed on the sheet P without changing the conveyance path PL of the sheet P in both the gloss mode and the non-gloss mode, thereby achieving downsizing of the image forming apparatus 100.

In the gloss mode, a period of time in which the sheet P is pressed at the fixing nip N1 of the fixing device 5 is preferably 30 m/sec or more, and is more preferably 60 m/sec or more, and a period of time in which the sheet P is pressed at the nip N2 of the gloss-imparting device 6 is preferably 15 m/sec or more. As a result, productivity same as that achieved in the non-gloss mode can be achieved in the gloss mode, thereby providing higher productivity in both the gloss mode and the non-gloss mode.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

Figure 14:
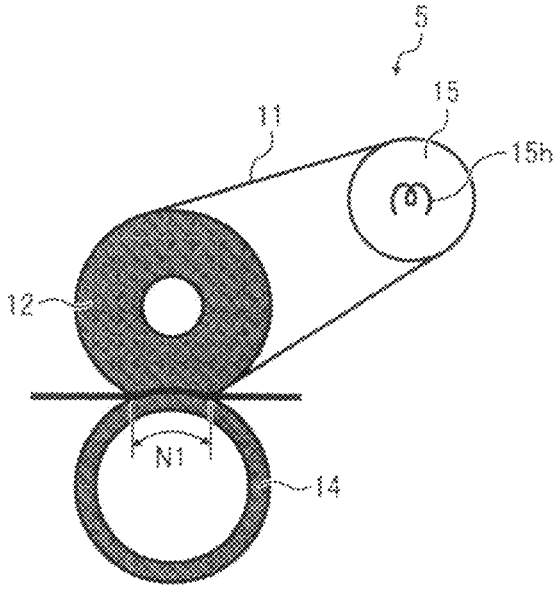
FIG. 14 is a vertical cross-sectional view illustrating another example of a configuration of a fixing device included in the image forming apparatus illustrated in FIG. 1.
Figure 15:
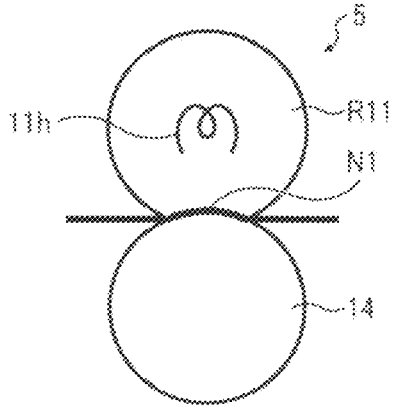
FIG. 15 is a vertical cross-sectional view illustrating yet another example of a configuration of the fixing device included in the image forming apparatus illustrated in FIG. 1.

For example, the separation roller 13 and the tension roller 16 of the fixing device 5 may be omitted from the image forming apparatus 100 illustrated in FIG. 2 to provide the fixing device 5 as illustrated in FIG. 14. Specifically, in the fixing device 5 illustrated in FIG. 14, only a single fixing nip N1 is formed between the fixing roller 12 and the pressure roller 14 with the fixing belt 11 therebetween. Alternatively, the fixing device 5 may include the fixing nip N1 facing downward formed between a fixing roller R11 and the pressure roller 14 as illustrated in FIG. 15. The fixing roller R11 includes a heater 11*h* serving as a heat source.

Figure 16:
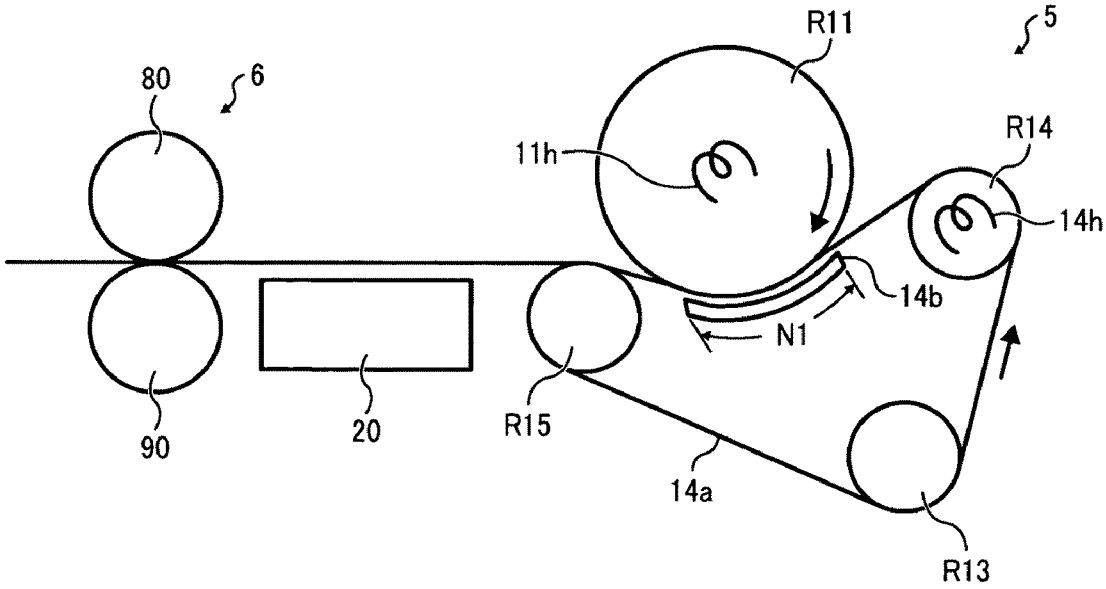
FIG. 16 is a vertical cross-sectional view illustrating still yet another example of a configuration of the fixing device included in the image forming apparatus illustrated in FIG. 1.

Further alternatively, the fixing device 5 illustrated in FIG. 16 is also applicable to the foregoing illustrative embodiments. The fixing device 5 illustrated in FIG. 16 includes the rotatable fixing roller R11; a pressing belt 14*a* rotatably wound around rollers R13, R14, and R15 provided below the fixing roller R11; and a backup member 14*b* serving as a pressure pad provided on a back surface of the pressing belt 14*a*. The backup member 14*b* causes the pressing belt 14*a* to contact the fixing roller R11 to form the fixing nip N1. The fixing roller R11 is heated by the heater 11*h* serving as a heat source provided within the fixing roller R11, and the pressing belt 14*a* is heated by a heater 14*h* provided within the roller R14. In the fixing device 5 illustrated in FIG. 16, the fixing roller R11 serves as a fixing member, and the pressing belt 14*a* wound around the multiple rollers R13, R14, and R15 serves as a pressing member. In such a case, also, the guide device 20 is provided between the fixing device 5 and the gloss-imparting device 6. Because the direction of the sheet P discharged from the fixing nip N1 is positioned above a hypothetical straight line connecting the exit of the fixing nip N1 and the entrance of the gloss-imparting device 6, a jet airflow is not generated from the second through-holes 21*s* in the guide device 20, and a suction airflow is generated from the second through-holes 21*s* in the guide device 20. Alternatively, the guide device 20 that ejects an airflow downward may be provided above the conveyance path PL of the sheet P.

In place of the gloss-imparting device 6 illustrated in FIG. 2, a second fixing device having a second fixing nip to apply heat and pressure on a side of the sheet P having the toner image thereon may be provided. Accordingly, the image forming apparatus 100 includes two fixing devices, that is, the fixing device 5 and the second fixing device, to fix the toner image on the sheet P. In such a case, the guide device 20 may be provided between the fixing device 5 and the second fixing device. Alternatively, a conveyance mechanism including a pair of rollers to merely convey the sheet P may be provided in place of the gloss-imparting device 6.

What is claimed is:

1. An image forming apparatus, comprising:

a fixing device having a first nip to fix toner to a recording medium by heat and pressure;

a conveyance device provided at a position downstream from the fixing device in a direction of conveyance of the recording medium where a leading edge of the recording medium reaches before a trailing edge of the recording medium is discharged from the first nip, to convey the recording medium further downstream;

a guide member provided along a conveyance path of the recording medium between the fixing device and the conveyance device to contact and convey the recording medium from the fixing device to the conveyance device, the guide member having multiple through-holes formed therein penetrating from a front surface of the guide member facing the conveyance path of the recording medium to a back surface of the guide member; and an airflow generator to generate an airflow through the multiple through-holes from the front surface of the guide member to the back surface of the guide member, wherein:

the multiple through-holes include first through-holes, the guide member further includes second through-holes upstream from the first through-holes in the direction of conveyance of the recording medium, the airflow generator generates a jet airflow through the second through-holes from the back surface of the guide member to the front surface of the guide member, and the airflow generator generates or stops generating the jet airflow through the second through-holes from the back surface of the guide member to the front surface of the guide member depending on a height relative to the guide member of the recording medium discharged from the first nip.

2. The image forming apparatus according to claim 1, wherein the conveyance device is one of a gloss-imparting device having a second nip for applying heat and pressure to the fixed toner on the recording medium and a second fixing device.

3. The image forming apparatus according to claim 1, wherein the airflow generator comprises an airflow control mechanism to control an airflow for at least a portion of the guide member.

4. The image forming apparatus according to claim 3, wherein the airflow control mechanism comprises a movable shielding member disposed adjacent to the guide member to close the multiple through-holes of at least a portion of the guide member for stopping the airflow and to open the multiple through-holes of at least a portion of the guide member for generating the airflow.

5. The image forming apparatus according to claim 4, wherein:

the shielding member comprises multiple partition plates that divide the shielding member into multiple sections, the partition plates being individually controlled to open and close the multiple through-holes.

6. The image forming apparatus according to claim 5, wherein the partition plates individually open and close the multiple through-holes depending on a degree of curling of the recording medium.

7. The image forming apparatus according to claim 6, wherein the degree of curling of the recording medium is either detected by a sensor or determined based on a thickness of the recording medium.

8. The image forming apparatus according to claim 1, wherein the fixing device comprises the first nip in which a direction of discharge of the recording medium from the first nip is closer to the guide member than a hypothetical straight line connecting an exit of the first nip and an entrance of the conveyance device.

9. The image forming apparatus according to claim 1, wherein the airflow generator generates or stops generating the airflow individually through the first and second through-holes.

10. An image forming method comprising:

fixing toner to a recording medium by heat and pressure using a fixing device having a first nip;

conveying the recording medium further downstream using a conveyance device provided at a position downstream from the fixing device in a direction of conveyance of the recording medium where a leading edge of the recording medium reaches before a trailing edge of the recording medium is discharged from the first nip;

contacting and conveying the recording medium from the fixing device to the conveyance device using a guide member provided along a conveyance path of the recording medium between the fixing device and the conveyance device, the guide member having multiple through-holes formed therein penetrating from a front surface of the guide member facing the conveyance path of the recording medium to a back surface of the guide member; and generating an airflow using an airflow generator through the multiple through-holes from the front surface of the guide member to the back surface of the guide member, wherein:

the multiple through-holes include first through-holes, the guide member further includes second through-holes upstream from the first through-holes in the direction of conveyance of the recording medium, generating a jet airflow through the second through-holes from the back surface of the guide member to the front surface of the guide member via the airflow generator, and generating or stop generating the jet airflow through the second through-holes from the back surface of the guide member to the front surface of the guide member depending on a height relative to the guide member of the recording medium discharged from the first nip via the airflow generator.

11. The image forming method according to claim 10, wherein the conveyance device is one of a gloss-imparting device having a second nip for applying heat and pressure to the fixed toner on the recording medium and a second fixing device.

12. The image forming method according to claim 10, wherein the airflow generator comprises an airflow control mechanism to control an airflow for at least a portion of the guide member, and controlling the airflow for at least a portion of the guide member with the airflow control mechanism.

13. The image forming method according to claim 12, wherein the airflow control mechanism comprises a movable shielding member disposed adjacent to the guide member to close the multiple through-holes of at least a portion of the guide member for stopping the airflow and to open the multiple through-holes of at least a portion of the guide member for generating the airflow.

14. The image forming method according to claim 13, wherein the shielding member comprises multiple partition plates that divide the shielding member into multiple sections, and individually controlling the partition plates to open and close the multiple through-holes depending on a degree of curling of the recording medium.

15. The image forming method according to claim 14, further comprising a step of detecting the degree of curling of the recording medium using a sensor.

16. The image forming method according to claim 14, further comprising a step of determining the degree of curling of the recording medium based on a thickness of the recording medium.

17. The image forming method according to claim 10, wherein the multiple through-holes include first through-holes and the guide member further includes second through-holes upstream from the first through-holes in the direction of conveyance of the recording medium, and generating a jet airflow through the second through-holes from the back surface of the guide member to the front surface of the guide member with the airflow generator.

18. An image forming apparatus, comprising:

a fixing device having a first nip to fix toner to a recording medium by heat and pressure;

a conveyance device provided at a position downstream from the fixing device in a direction of conveyance of the recording medium where a leading edge of the recording medium reaches before a trailing edge of the recording medium is discharged from the first nip, to convey the recording medium further downstream;

a guide member provided along a conveyance path of the recording medium between the fixing device and the conveyance device to contact and convey the recording medium from the fixing device to the conveyance device, the guide member having multiple through-holes formed therein penetrating from a front surface of the guide member facing the conveyance path of the recording medium to a back surface of the guide member; and an airflow generator to generate an airflow through the multiple through-holes from the front surface of the guide member to the back surface of the guide member, wherein:

the multiple through-holes include first through-holes, the guide member further includes second through-holes upstream from the first through-holes in the direction of conveyance of the recording medium, the airflow generator generates a jet airflow through the second through-holes from the back surface of the guide member to the front surface of the guide member, and the airflow generator generates or stops generating the airflow individually through the first and second through-holes.

19. An image forming method comprising:

fixing toner to a recording medium by heat and pressure using a fixing device having a first nip;

conveying the recording medium further downstream using a conveyance device provided at a position downstream from the fixing device in a direction of conveyance of the recording medium where a leading edge of the recording medium reaches before a trailing edge of the recording medium is discharged from the first nip;

contacting and conveying the recording medium from the fixing device to the conveyance device using a guide member provided along a conveyance path of the recording medium between the fixing device and the conveyance device, the guide member having multiple through-holes formed therein penetrating from a front surface of the guide member facing the conveyance path of the recording medium to a back surface of the guide member; and generating an airflow using an airflow generator through the multiple through-holes from the front surface of the guide member to the back surface of the guide member, wherein:

the multiple through-holes include first through-holes, the guide member further includes second through-holes upstream from the first through-holes in the direction of conveyance of the recording medium, generating a jet airflow through the second through-holes from the back surface of the guide member to the front surface of the guide member via the airflow generator, and generating or stop generating the airflow individually through the first and second through-holes via the airflow generator.

* * * * *